US007367156B2

(12) United States Patent
Kondo et al.

(10) Patent No.: US 7,367,156 B2
(45) Date of Patent: May 6, 2008

(54) INKJET RECORDING DEVICE AND INKJET RECORDING METHOD

(75) Inventors: Masaki Kondo, Toyoake (JP); Yasunari Yoshida, Ama-gun (JP); Masashi Ueda, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 248 days.

(21) Appl. No.: 11/006,686

(22) Filed: Dec. 8, 2004

(65) Prior Publication Data

US 2005/0140712 A1 Jun. 30, 2005

(30) Foreign Application Priority Data

Dec. 9, 2003 (JP) ..... 2003-410778

(51) Int. Cl.
*B41J 2/205* (2006.01)

(52) U.S. Cl. ..... 47/15; 347/14; 358/3.01

(58) Field of Classification Search ..... 347/15, 347/43, 14

See application file for complete search history.

(56) References Cited

U.S. PATENT DOCUMENTS 4,673,951 A * 6/1987 Mutoh et al. ..... 347/15
5,430,469 A 7/1995 Shioya et al.
5,650,803 A 7/1997 Tamura et al.
5,777,640 A 7/1998 Shioya et al.
5,844,582 A 12/1998 Shioya
6,012,796 A 1/2000 Tanaka
6,053,596 A * 4/2000 Nakano et al. ..... 347/15
6,120,121 A 9/2000 Tanaka
6,120,123 A 9/2000 Tanaka
6,260,939 B1 7/2001 Shioya et al.
6,309,051 B1 10/2001 Koitabashi et al.
6,325,492 B1 12/2001 Koitabashi et al.
6,406,114 B1 6/2002 Shioya
6,454,389 B1 9/2002 Couwenhoven et al.
6,513,906 B1 2/2003 Tanaka et al.
6,554,384 B1 4/2003 Tanaka
6,572,216 B1 6/2003 Koitabashi et al.
6,846,066 B2 * 1/2005 Teshikawara et al. ..... 347/40
2002/0024563 A1 2/2002 Koitabashi et al.
2002/0186277 A1 12/2002 Hidehiko et al.

(Continued)

FOREIGN PATENT DOCUMENTS

JP B2-2875641 1/1999

(Continued)

*Primary Examiner*—Thinh Nguyen
(74) *Attorney, Agent, or Firm*—Oliff & Berridge, PLC

(57) ABSTRACT

An inkjet recording device records images by forming dots on a recording medium with droplet modulating method. The inkjet recording device includes a recording unit, a multilevel-data creating portion, and a dot-layout-data creating portion. The recording unit ejects ink droplets for forming dots at corresponding pixel positions. The recording unit is capable of changing a volume of each ink droplet to form dots with different sizes. The multilevel-data creating portion creates multilevel data based on image data. The multilevel data includes a dot size for each dot. The dot-layout-data creating portion creating dot layout data based on the multilevel data, so as to prevent the recording unit from forming dots having the same size continuously by greater than or equal to a predetermined number. The recording unit performs recording operation based on the dot layout data.

30 Claims, 20 Drawing Sheets

U.S. PATENT DOCUMENTS

| | | | | |
|---|---|---|---|---|
| 2003/0038853 | A1* | 2/2003 | Moroo | 347/15 |
| 2003/0090537 | A1 | 5/2003 | Tanaka et al. | |

FOREIGN PATENT DOCUMENTS

| | | |
|---|---|---|
| JP | B2-2963032 | 8/1999 |
| JP | B2-3176124 | 4/2001 |
| JP | B2-3183797 | 4/2001 |
| JP | A-2002-120387 | 4/2002 |
| JP | A-2002-264367 | 9/2002 |
| JP | A-2003-053963 | 2/2003 |

* cited by examiner

FIG.14(a)

DIVIDING MASK

| | 1 | 2 | 3 | 4 | 5 | 6 | 7 | 8 | 9 | 10 | 11 | 12 | 13 | 14 | 15 | 16 | 17 | 18 |
|---|---|---|---|---|---|---|---|---|---|---|---|---|---|---|---|---|---|---|
| FIRST PASS | S | L | S | × | M | L | × | L | S | × | M | L | × | L | S | × | M | L |
| SECOND PASS | S | × | M | × | S | × | M | × | M | × | S | × | S | × | M | × | S | × |
| THIRD PASS | S | × | × | L | × | × | S | × | × | L | × | × | M | × | × | L | × | × |

FIG.14(b)

POSSIBLE COMBINATIONS

| | | | | | | | | | | |
|---|---|---|---|---|---|---|---|---|---|---|
| FIRST PASS | S | S | M | S | M | × | × | L | × | × |
| SECOND PASS | S | M | S | × | × | S | M | × | L | × |
| THIRD PASS | S | × | × | M | S | M | S | × | × | L |

DIVIDING MASK

| | CELL NO. | | | | | | | | | | | | | | | | | |
|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 |
| FIRST PASS | S | L | S | X | M | L | X | L | S | X | M | L | X | L | S | X | M | L |
| SECOND PASS | S | X | M | X | S | X | M | X | M | X | S | X | S | X | M | X | S | X |
| THIRD PASS | S | X | X | L | X | X | S | X | X | L | X | X | M | X | X | L | X | X |

FIG.15(a)

DOT LAYOUT DATA PRIOR TO DIVISION

| | PIXEL (K) | | | | | | | | | | | | | | | | | |
|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 |
| | S | S | S | S | S | S | S | S | S | S | S | S | S | S | S | S | S | S |

FIG.15(b)

DOT LAYOUT DATA AFTER DIVISION

| | PIXEL (K) | | | | | | | | | | | | | | | | | |
|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 |
| FIRST PASS | S | S | S | X | S | S | X | S | S | X | S | S | X | S | S | X | S | S |
| SECOND PASS | X | X | X | X | X | X | S | X | X | X | X | X | S | X | X | X | X | X |
| THIRD PASS | X | X | X | S | X | X | X | X | X | S | X | X | X | X | X | S | X | X |

FIG.15(c)

DIVIDING MASK

| | CELL NO. | | | | | | | | | | | | | | | | | |
|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 |
| FIRST PASS | S | L | S | X | M | L | X | L | S | X | M | L | X | L | S | X | M | L |
| SECOND PASS | S | X | M | X | S | X | M | X | M | X | S | X | S | X | M | X | S | X |
| THIRD PASS | S | X | X | L | X | X | S | X | X | L | X | X | M | X | X | L | X | X |

FIG.16(a)

DOT LAYOUT DATA PRIOR TO DIVISION

| | PIXEL (K) | | | | | | | | | | | | | | | | | |
|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 |
| | M | M | M | M | M | M | M | M | M | M | M | M | M | M | M | M | M | M |

....

FIG.16(b)

DOT LAYOUT DATA AFTER DIVISION

| | PIXEL (K) | | | | | | | | | | | | | | | | | |
|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 |
| FIRST PASS | S | M | S | X | M | M | X | M | S | X | M | M | X | M | S | X | M | M |
| SECOND PASS | S | X | S | X | X | X | M | X | S | X | X | X | S | X | S | X | X | X |
| THIRD PASS | X | X | X | M | X | X | X | X | X | M | X | X | S | X | X | M | X | X |

....

FIG.16(c)

FIG.17(a)

DIVIDING MASK

| | CELL NO. | | | | | | | | | | | | | | | | | |
|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 |
| FIRST PASS | S | L | S | × | M | L | × | L | S | × | M | L | × | L | S | × | M | L |
| SECOND PASS | S | × | M | × | S | × | M | × | M | × | S | × | S | × | M | × | S | × |
| THIRD PASS | S | × | × | L | × | × | S | × | × | L | × | × | M | × | × | L | × | × |

FIG.17(b)

DOT LAYOUT DATA PRIOR TO DIVISION

| PIXEL (K) | | | | | | | | | | | | | | | | | | |
|---|---|---|---|---|---|---|---|---|---|---|---|---|---|---|---|---|---|---|
| 1 | 2 | 3 | 4 | 5 | 6 | 7 | 8 | 9 | 10 | 11 | 12 | 13 | 14 | 15 | 16 | 17 | 18 | .... |
| L | L | L | L | L | L | L | L | L | L | L | L | L | L | L | L | L | L | |

FIG.17(c)

DOT LAYOUT DATA AFTER DIVISION

| | PIXEL (K) | | | | | | | | | | | | | | | | | | |
|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | |
| FIRST PASS | S | L | S | × | M | L | × | L | S | × | M | L | × | L | S | × | M | L | .... |
| SECOND PASS | S | × | M | × | S | × | M | × | M | × | S | × | S | × | M | × | S | × | |
| THIRD PASS | S | × | × | L | × | × | S | × | × | L | × | × | M | × | × | L | × | × | |

FIG.18(a)

DIVIDING MASK

| | PIXEL (K) | | | | | | | | | | | | | | | | | |
|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 |
| FIRST PASS | S | L | S | × | M | L | × | L | S | M | M | L | × | L | S | M | M | L |
| SECOND PASS | S | × | M | × | S | × | M | × | M | × | S | × | M | × | M | × | S | × |
| THIRD PASS | S | × | × | L | × | × | S | × | × | S | × | × | S | × | × | L | × | × |

FIG.18(b)

DOT LAYOUT CONTROL (DIVIDING PROCESS) PERFORMED ON DATA WITH CONSECUTIVE SMALL DOT SIZES

| | PIXEL (K) | | | | | | | | | | | | | | | | | | |
|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | |
| FIRST PASS | S | S | S | × | S | S | × | S | S | S | S | S | × | S | S | S | S | S | .... |
| SECOND PASS | × | × | × | × | × | × | S | × | × | × | × | × | S | × | × | × | × | × | |
| THIRD PASS | × | × | × | S | × | × | × | × | × | × | × | × | × | × | × | × | × | × | |

FIG.18(c)

DOT LAYOUT CONTROL (DIVIDING PROCESS) PERFORMED ON DATA WITH CONSECUTIVE MEDIUM DOT SIZES

| | PIXEL (K) | | | | | | | | | | | | | | | | | | |
|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | |
| FIRST PASS | S | M | S | M | M | M | × | M | S | M | M | M | × | M | S | M | M | M | .... |
| SECOND PASS | S | × | S | × | × | × | M | × | S | × | × | × | M | × | S | × | × | × | |
| THIRD PASS | × | × | × | × | × | × | × | × | × | × | × | × | × | × | × | × | × | × | |

FIG.18(d)

DOT LAYOUT CONTROL (DIVIDING PROCESS) PERFORMED ON DATA WITH CONSECUTIVE LARGE DOT SIZES

| | PIXEL (K) | | | | | | | | | | | | | | | | | | |
|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | |
| FIRST PASS | S | L | S | M | M | L | × | L | S | M | M | L | × | L | S | M | M | L | .... |
| SECOND PASS | S | × | M | × | S | × | M | × | M | × | S | × | M | × | M | × | S | × | |
| THIRD PASS | S | × | × | S | × | × | S | × | × | S | × | × | S | × | × | S | × | × | |

INKJET RECORDING DEVICE AND INKJET RECORDING METHOD

BACKGROUND OF THE INVENTION

1. Field of the Invention

The present invention relates to an inkjet recording device provided with an inkjet recording head having a plurality of ink discharge holes, and employing a droplet modulating system for recording images. The present invention also relates to an inkjet recording method for controlling the inkjet recording device.

2. Description of Related Art

Conventional inkjet recording devices have employed recording systems capable of representing different tones (gradations) at each pixel, such as a multidroplet method and a droplet modulating method. The multidroplet method produces tones by varying the number of ink droplets ejected for each pixel. The droplet modulating method produces tones by changing the volume of the ink droplet (droplet diameter) ejected for each pixel.

Any deviation in the directions and amounts of ink droplets ejected from the plurality of discharge holes formed in the recording head may produce streaks in images that were meant to have uniform density variations, or unevenness in the density of the image. In other words, irregularity in the direction of ink ejection may cause deviations in the positions of dots formed on the recording paper, producing lines in the recorded image. Further, if there is any irregularity in the amount of ink ejected, the size or density of dots formed on the recording paper will be irregular, resulting in an uneven density in the recorded image.

One technique for resolving this problem involves recording the same line in multiple scans using different ink discharge holes for each scan. This technique, hereinafter referred to as the multipass recording method, ejects ink droplets from a plurality of nozzles to record the same line. Multipass recording attempts to produce a beautiful image by dispersing variations in the directions and amounts of ink ejected from each nozzle (attempts to produce a density that appears even to the human eye).

Examples of printers employing this technique include inkjet printers using a multidrop system or capable of multipass recording, such as that disclosed in Japanese patent No. 3176124. By using such an inkjet printer to record a single line with the multipass recording method, an image of better quality can be produced than when recording the same line with a single nozzle, as described above.

However, in the inkjet printer according to patent No. 3176124, all of the ink droplets ejected from the recording head have the same dot size. Since the same dot size is used, tones from light regions to dark regions are represented using a predetermined dot density (also called resolution). Therefore, it is necessary to use a relatively large dot size, which can lead to a graininess or rough texture in the recorded image.

Accordingly, an inkjet printer is proposed in Japanese patent No. 2963032 that is provided not only with a multidroplet system and a multipass recording capacity, but also with a droplet modulating capacity. With this capacity for regulating droplets, that is, varying the dot size of droplets ejected from the recording head, the inkjet printer according to Japanese patent No. 2963032 can reduce the graininess and rough texture in the recorded image.

SUMMARY OF THE INVENTION

However, the inkjet printer according to Japanese patent No. 2963032 forms dots at a fixed size when recording solids represented with only large dots, or halftones represented with only medium dots. During these recording operations, the inkjet head continuously ejects droplets of the same size.

As shown in FIG. 19, when the inkjet head ejects ink droplets of a specific size, "satellites" are sometimes produced along with the primary dot. If the inkjet head continuously ejects ink droplets of the size that produces these satellites, there is a danger that, in addition to a line formed by the primary dots, a dotted line or the like similar to a light stain may be generated on the recording paper by the satellites. In other words, when the inkjet printer according to Japanese patent No. 2963032 continuously ejects dots of a specific size, there is a danger that noise caused by the droplet size will be highly visible.

In view of the foregoing, it is an object of the present invention to provide an inkjet recording device and inkjet recording method capable of reducing the effects of noise caused by a specific size of ink droplets.

In order to attain the above and other objects, the present invention provides an inkjet recording device for recording images by forming dots on a recording medium with droplet modulating method. The inkjet recording device includes a recording unit, a multilevel-data creating portion, and a dot-layout-data creating portion. The recording unit ejects ink droplets for forming dots at corresponding pixel positions. The recording unit is capable of changing a volume of each ink droplet to form dots with different sizes. The multilevel-data creating portion creates multilevel data based on image data. The multilevel data include a dot size for each dot. The dot-layout-data creating portion creates dot layout data based on the multilevel data, so as to prevent the recording unit from forming dots having the same size continuously by greater than or equal to a predetermined value. The recording unit performs recording operation based on the dot layout data.

The present invention also provides an inkjet recording method for recording images by forming dots on a recording medium with droplet modulating method, using a recording unit capable of changing a volume of each ink droplet to form dots with different sizes. The inkjet recording method includes creating multilevel data based on image data, the multilevel data including a dot size for each dot, creating dot layout data based on the multilevel data so as to prevent the recording unit from forming dots having the same size continuously by greater than or equal to a predetermined value, and performing recording operation by ejecting ink droplets, thereby forming dots at corresponding pixel positions based on the dot layout data.

BRIEF DESCRIPTION OF THE DRAWINGS

The above and other objects, features and advantages of the invention will become more apparent from reading the following description of the embodiments taken in connection with the accompanying drawings in which:

FIG. 7(*b*) is an explanatory diagram showing a pseudo-gradation process;

FIG. 14(*a*) is an explanatory diagram showing an example of a dividing mask used in the dividing process of dot layout control;

FIG. 14(*b*) is an explanatory diagram showing possible combinations of dot sizes used in the dividing process;

FIG. 15(*a*) is an explanatory diagram showing the dividing mask used in the dividing process;

FIG. 15(*b*) is an explanatory diagram showing dot layout data prior to performing the dividing process which includes only small dots in succession;

FIG. 15(*c*) is an explanatory diagram showing dot layout data after performing the dividing process on the dot layout data of FIG. 15(*b*);

FIG. 16(*a*) is an explanatory diagram showing the dividing mask used in the dividing process;

FIG. 16(*b*) is an explanatory diagram showing dot layout data prior to performing the dividing process which includes only medium dots in succession;

FIG. 16(*c*) is an explanatory diagram showing dot layout data after performing the dividing process on the dot layout data of FIG. 16(*b*);

FIG. 17(*a*) is an explanatory diagram showing the dividing mask used in the dividing process;

FIG. 17(*b*) is an explanatory diagram showing dot layout data prior to performing the dividing process which includes only large dots in succession;

FIG. 17(*c*) is an explanatory diagram showing dot layout data after performing the dividing process on the dot layout data of FIG. 17(*b*);

FIG. 18(*a*) is an explanatory diagram showing another example of the dividing mask used in the dividing process;

FIG. 18(*b*) is an explanatory diagram showing dot layout data after performing the dividing process on dot layout data with consecutive small dot sizes;

FIG. 18(*c*) is an explanatory diagram showing dot layout data after performing the dividing process on dot layout data with consecutive medium dot sizes;

FIG. 18(*d*) is an explanatory diagram showing dot layout data after performing the dividing process on dot layout data with consecutive large dot sizes.

DETAILED DESCRIPTION OF THE PREFERRED EMBODIMENTS

An inkjet recording device and inkjet recording method according to an embodiment of the present invention will be described. The present embodiment applies the inkjet recording device to a multifunction device having a facsimile function, scanner function, copier function, and printer function.

(a) First, the construction of the multifunction device will be described with reference to FIGS. 1 to 4.

Figure 1:
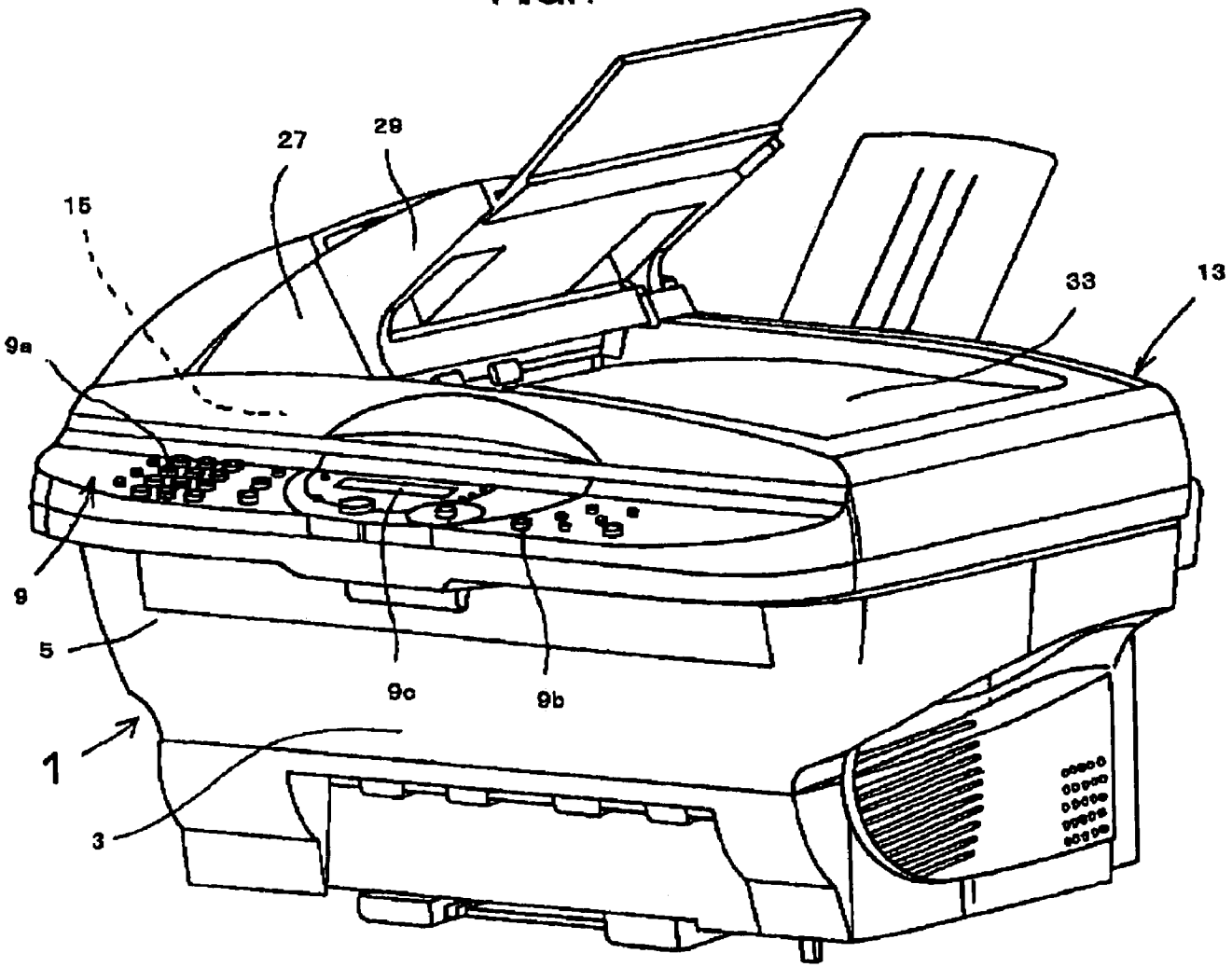
FIG. 1 is a perspective view showing the general structure of a multifunction device according to an embodiment of the present invention.
Figure 2:
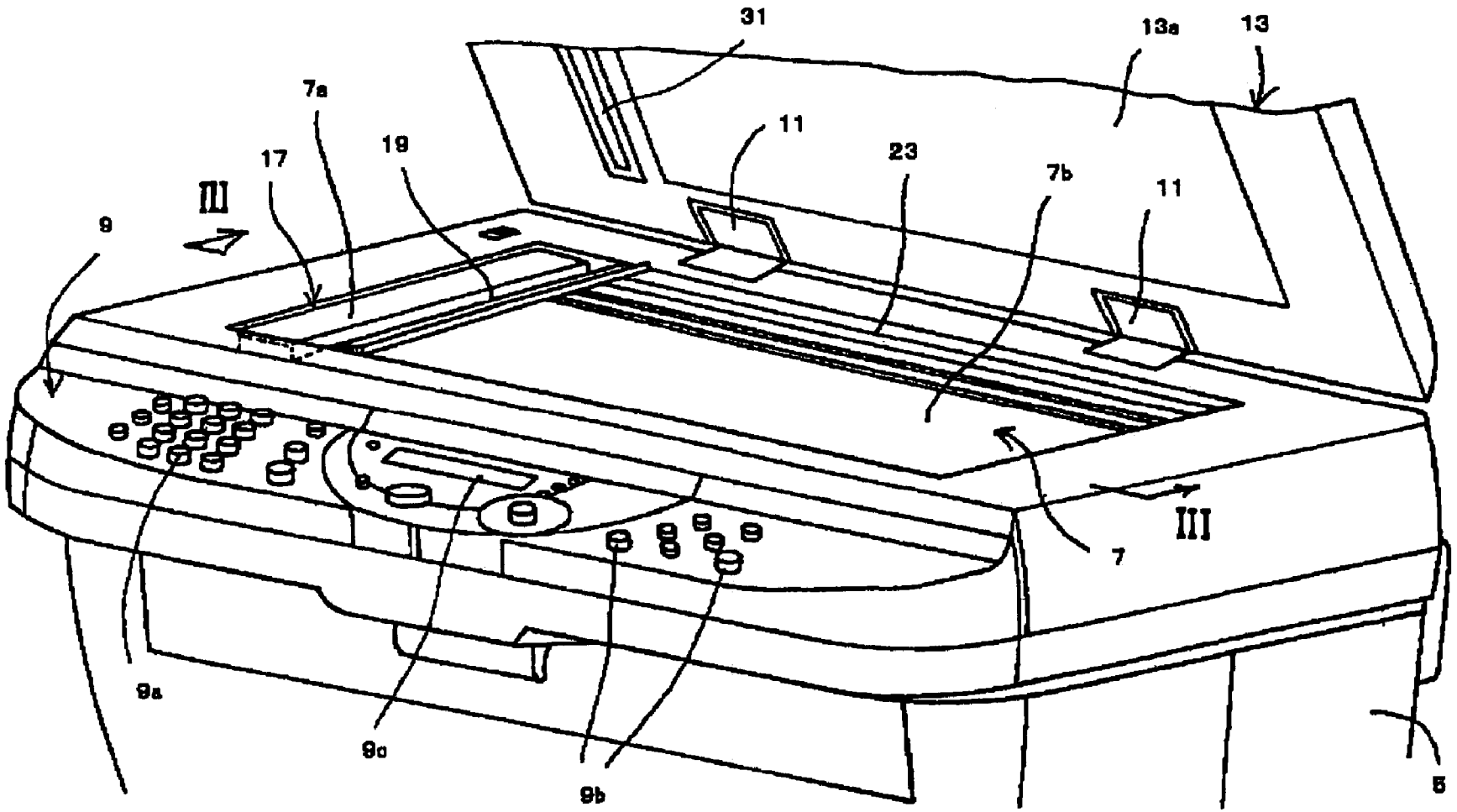
FIG. 2 is a perspective view showing part of the multifunction device when a cover on the device is pivotally open from a main casing.

As shown in FIGS. 1 and 2, a multifunction device 1 includes a main casing 5, and a printing unit 3 described later that is accommodated in the main casing 5. A large glass plate 7 for supporting an original document is fixed in a level state on the top surface of the main casing 5. A control panel 9 is disposed near the front on the top surface of the main casing 5. The control panel 9 includes a keypad 9*a* for executing the facsimile function, scanner function, and copier function; buttons 9*b* for issuing commands to perform various operations; and a liquid crystal display (LCD) 9*c* for displaying the content of commands, errors, and the like. A cover 13 is mounted on the top surface of the main casing 5 via hinges 11 provided on the rear edge thereof and is capable of swinging open and closed via the hinges 11.

The multifunction device 1 according to the present invention is provided with an image-scanning device 15 for implementing the scanning function, copier function, and facsimile function, and an image-scanning unit 17 that moves within the main casing 5 along the underside of the glass plate 7. The glass plate 7 is formed in a rectangular shape, and a guide piece 19 is disposed on one longitudinal end of the glass plate 7 extending along the edge. The guide piece 19 serves to divide the longitudinal length of the glass plate 7 into an end glass plate 7*a* described later having a short length in the scanning direction, and a document supporting portion 7*b*, which is a central glass plate having a long length in the scanning direction (see FIGS. 2 and 3). An original document is supported in a stationary state on the document supporting portion 7*b*.

Figure 3:
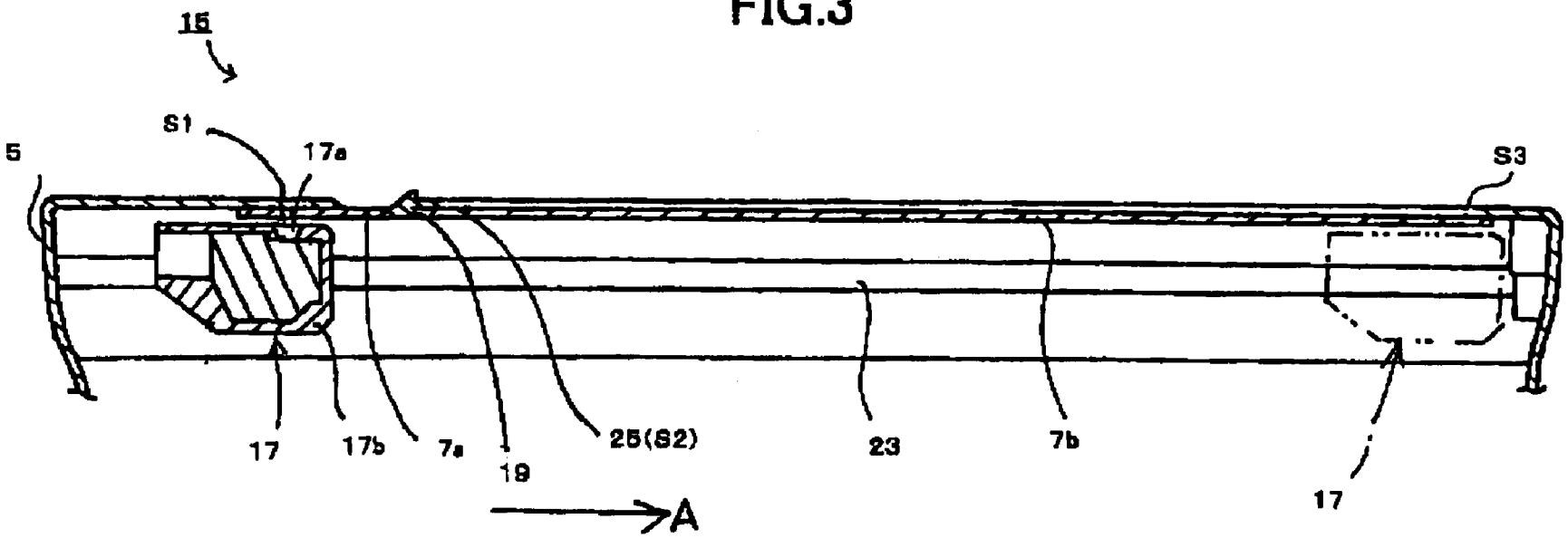
FIG. 3 is a side cross-sectional view of an image-scanning device.

A pair of guide rails 23 arranged parallel to one another in the scanning direction is disposed on the underside of the glass plate 7 (only one is shown in FIGS. 2 and 3). The image-scanning unit 17 is configured of a line-type CCD element (not shown) mounted on a carriage 17*b*. The carriage 17*b* is driven to move reciprocatingly along the guide rails 23 by a step motor and a timing belt or other transmission mechanism (not shown). A scanning window 17*a* is formed in the carriage 17*b* opposite the original document surface for receiving light reflected from the document surface. When the image-scanning unit 17 is in a standby mode, the center of the scanning window 17*a* in the scanning direction is at a moving start position S1 (see FIG. 3).

An original document placed on the document supporting portion 7*b* is positioned so that the leading edge of the document on the upstream side of the scanning direction contacts a document contact edge 25, which is a side edge of the guide piece 19 on the downstream side in the scanning direction. Accordingly, the document is placed on the document supporting portion 7*b* with the recorded surface of the document face down. A pressing member 13*a* formed of a sponge or the like and a white plate is disposed on the bottom surface of the cover 13 for holding the document in place on the document supporting portion 7*b*. In this state, the image-scanning unit 17, which is halted on the underside of the end glass plate 7*a* in a standby position moves in a direction A (scanning direction) indicated by an arrow in FIG. 3. As the image-scanning unit 17 passes over the bottom surface of the document supporting portion 7*b*, the line type CCD element scans images from the document placed on the document supporting portion 7*b* via the scanning window 17*a*.

FIG. 3 shows positions of the image-scanning unit 17. When the image-scanning unit 17 is in the standby mode, the center of the scanning window 17*a* in the scanning direction is at the moving start position S1, as described above. When the image-scanning unit 17 begins scanning images from a document placed on the document supporting portion 7*b* with the leading edge of the document in the scanning direction contacting the document contact edge 25 of the guide piece 19, the center of the scanning window 17*a* is at a scanning start position S2. An absolute stop position S3 is a position at which the image-scanning unit 17 must stop after scanning the image area just prior to contacting the surface of the main casing 5. The image area is the region to be scanned by the image-scanning unit 17 on the surface of a document appropriately placed on the document supporting portion 7*b* and normally should be the entire surface of the document. Hence, the length of the image region in the scanning direction is equivalent to the length of the document. However, if the region to be scanned by the image-scanning unit 17 is set to part of the region within the surface of a properly set document based on a pre-scan performed according to an instruction from an external personal computer or the like (not shown), the length of the image area is set to the length in the scanning direction from the leading edge of the document to a position just past the region set in the pre-scan.

In addition to scanning a document placed on the document supporting portion 7*b*, the image-scanning device 15 is also configured to scan an automatically fed document. In the present embodiment, an automatic feeder 27 is disposed to one side on the top surface of the cover 13. The automatic feeder 27 has a document tray 29 for holding original documents in a stacked state. A feeding roller (not shown) housed in the automatic feeder 27 separates and feeds the documents one sheet at a time into the automatic feeder 27 after which the document is conveyed by conveying rollers (not shown). At this time, a portion of the document is sequentially exposed in an opening 31 formed in the bottom of the cover 13 that opposes the end glass plate 7*a*, enabling the image-scanning unit 17 halted below the end glass plate 7*a* to scan images from the document sequentially. Subsequently, the document is guided by the guide piece 19 along a discharge path (not shown) in the automatic feeder 27 and discharged onto a discharge tray 33. A detailed description of the construction and operations of this type of automatic feeder 27 will not be given since the construction and operations are well known in the art and are not directly related to the present invention.

Figure 4:
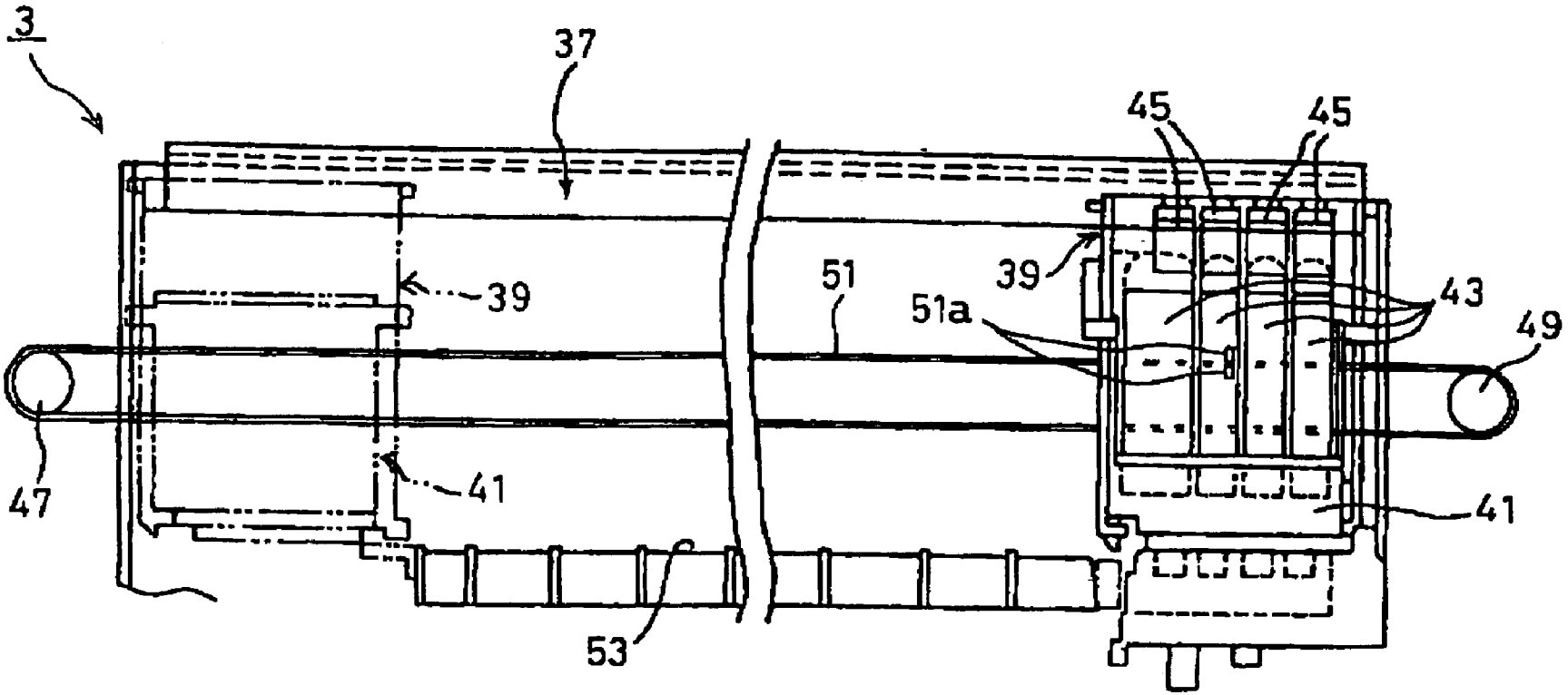
FIG. 4 is a plan view showing a rear section of a printing unit.

Next, the printing unit 3 will be described with reference to FIG. 4. The printing unit 3 includes a frame 37 with its longitudinal size running left-to-right. A guide shaft (not shown) is disposed along the longitudinal direction of the frame 37. A carriage 39 is mounted in contact with the guide shaft and is capable of moving reciprocatingly in the longitudinal direction.

A recording head 41 that employs color inkjet cartridges is mounted facing downward in the carriage 39. The recording head 41 has four nozzle sections (not shown) formed in the bottom surface thereof for injecting ink of the colors cyan, yellow, magenta, and black. Ink cartridges 43 can be detachably mounted on the top surface side of the recording head 41 for accommodating ink of each of the aforementioned colors to be supplied to the recording head 41. Retaining levers 45 that can be manually rotated up and down are disposed at the top end of the carriage 39 for fixing the ink cartridges 43 in a downward facing position.

A passive pulley 47 is disposed near one end of the printing unit 3, while a drive pulley 49 is disposed on the opposite end and is fixed to the output shaft of a drive motor (not shown), such as a stepping motor that can rotate both in a forward and reverse direction. A timing belt 51 is looped around the passive pulley 47 and drive pulley 49 and has a point 51*a* that couples with the carriage 39. Hence, when the drive pulley 49 rotates, the driving force of the drive pulley 49 is transferred to the carriage 39 via the timing belt 51, causing the carriage 39 to move reciprocatingly in the longitudinal direction.

The multifunction device 1 also includes a paper conveying mechanism 63 (FIG. 5) having a paper tray and a feeding roller well known in the art; and a platen 53 that confronts the recording head 41 as the recording head 41 moves reciprocatingly. Recording paper supplied by the paper conveying mechanism 63 is conveyed between the recording head 41 and platen 53 to be printed. Subsequently, the recording paper is conveyed by conveying rollers known in the art and discharged onto the discharge tray 33.

Figure 5:
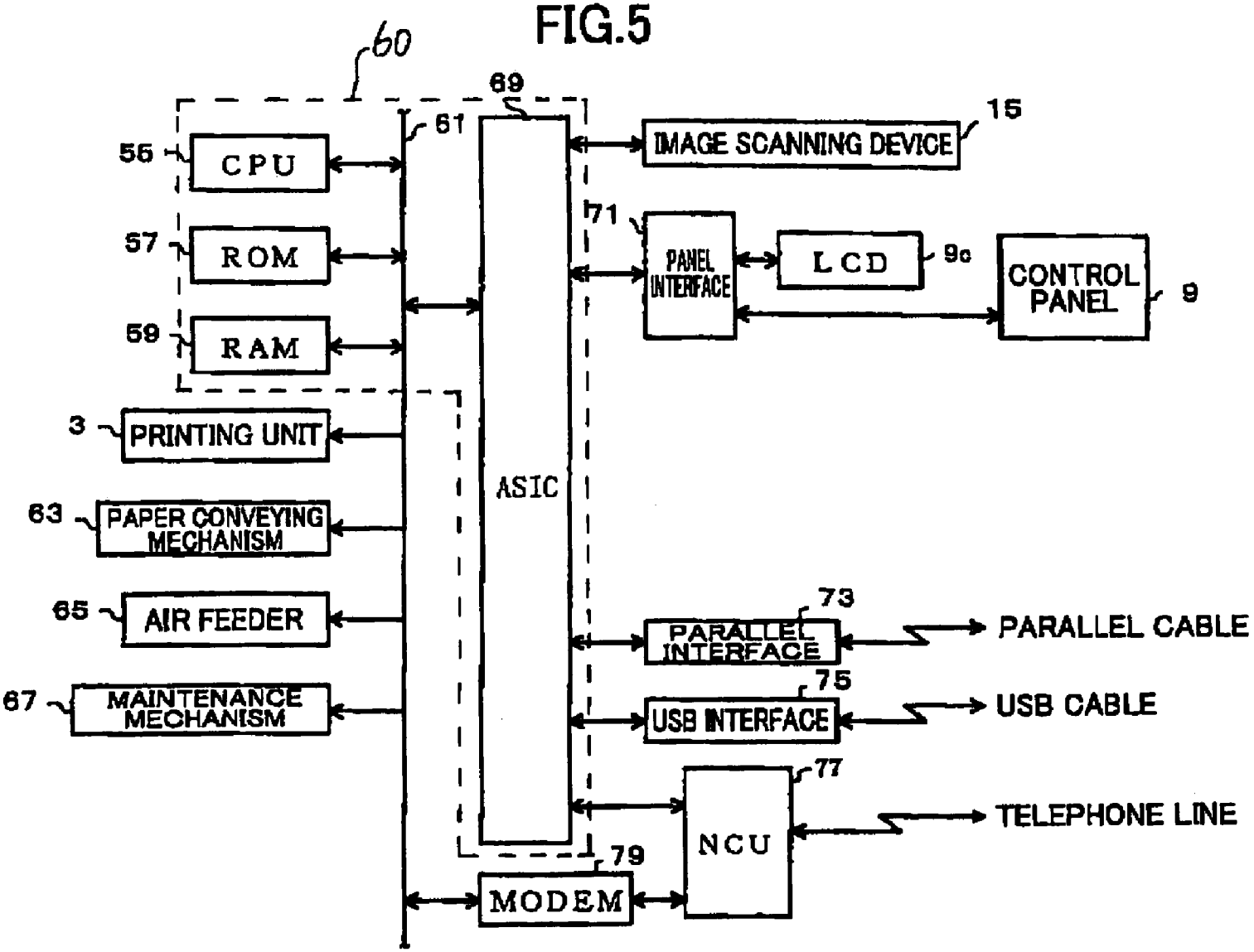
FIG. 5 is a block diagram showing a control system.

(b) Next, a control system provided in the multifunction device 1 will be described with reference to the block diagram in FIG. 5.

The control system of the multifunction device 1 includes a CPU 55, a ROM 57, and a RAM 59 that are connected together via a bus 61 such as a data bus. The bus 61 is also connected to the printing unit 3, the paper conveying mechanism 63, an air feeder 65 for supplying air used for supplying ink and the like, a maintenance mechanism 67 for maintaining the recording head 41, an input/output ASIC (application specific integrated circuit) 69 formed of a hardware logic circuit, and the like. The CPU 55, ROM 57, RAM 59, and input/output ASIC 69 constitute a controller 60.

The input/output ASIC 69 is also connected to the image-scanning device 15, a panel interface 71 for providing interfaces between the input/output ASIC 69 and the control panel 9, LCD 9*c*, and the like, a parallel interface 73 connected to an external personal computer or the like via a parallel cable, a USS interface 75 connected to various external devices via USB cables, and a network control unit (NCU) 77 connected to an external telephone line. A section of the NCU is also connected to the bus 61 via a modem 79.

Various control programs for implementing a printing process and the like described later are pre-stored in the ROM 57. The RAM 59 includes a data storage memory for storing various data inputted via the parallel cable and USB cables, a data transmission memory for transmitting data to an external destination via the parallel cable and USB cables, and other memory.

(c) Next, an outline of a printing process executed by the multifunction device 1 will be described with reference to the flowchart in FIG. 6.

Figure 6:
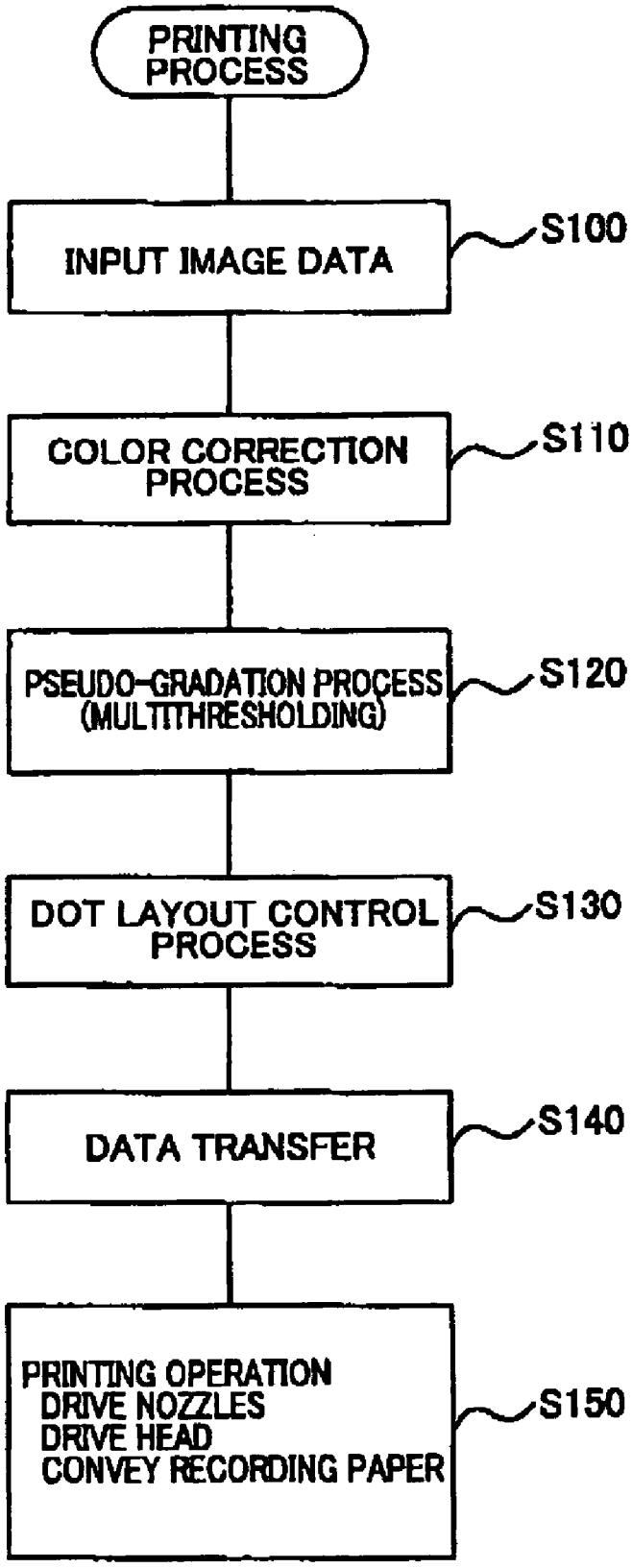
FIG. 6 is a flowchart showing the steps in a printing process.

In S100 of FIG. 6 image data is inputted into the controller 60. The image data is data that the image-scanning device 15 has read from a document.

In S110 the controller 60 executes a color correction process on the image data. Specifically, since the image data is recorded according to signals in the RGB color system, these signals are converted to signals for cyan (C), magenta (M), yellow (Y), and black (K), that is, signals for controlling the printing unit 3.

More specifically, signals in the RGB color system are converted to X, Y, and Z signals according to equations (1)-(6) below.

$$SR=(R/255)^{\gamma r} \quad (1)$$

$$SG=(G/255)^{\gamma g} \quad (2)$$

$$SB=(B/255)^{\gamma b} \quad (3)$$

$$X=SR*Xr+SG*Xg+SB*Xb \quad (4)$$

$$Y=SR*Yr+SG*Yg+SB*Yb \quad (5)$$

$$Z=SR*Zr+SG*Zg+SB*Zb \quad (6)$$

In equations (1)-(6), R, G, and B are tone values for each of the three primary colors, while the γr, γg, and γb are the γ values, and powers, for each component of the three primary colors. Further, SR, SG, and SB are luminance values for each component of the three primary colors; Xr, Yr, and Zr are the XYZ values for red (R) light; Xg, Yg, and Zg are the XYZ values for green (G) light; and Xb, Yb, and Zb are the XYZ values for blue (B) light. Of these, the γ values γr, γg, and γb and the XYZ values Xr, Yr, Zr, Xg, Yg, Zg, Xb, Yb, and Zb are pre-stored in the ROM 57 as profile data (conversion characteristics for the color conversion mechanism).

Next, the X, Y, and Z signals are converted to Lab signals according to the following equations (7)-(9).

$$L=(Y/Yn)^{1/3}*116-16 \quad (7)$$

$$a=500*((X/Xn)^{1/3}-(Y/Yn)^{1/3}) \quad (8)$$

$$b=200*((Y/Yn)-(Z/Zn)^{1/3}) \quad (9)$$

In equations (7)-(9), "*" is a multiplication symbol: X, Y, and Z are the values of each component in the XYZ color system; Xn, Yn, and Zn are the X, Y, and Z values for standard white color determined by the profile data; and L, a, and b are the values for each component in a color space for the Lab color system employing 3D (three-dimensional) Cartesian coordinates.

Figure 7A:
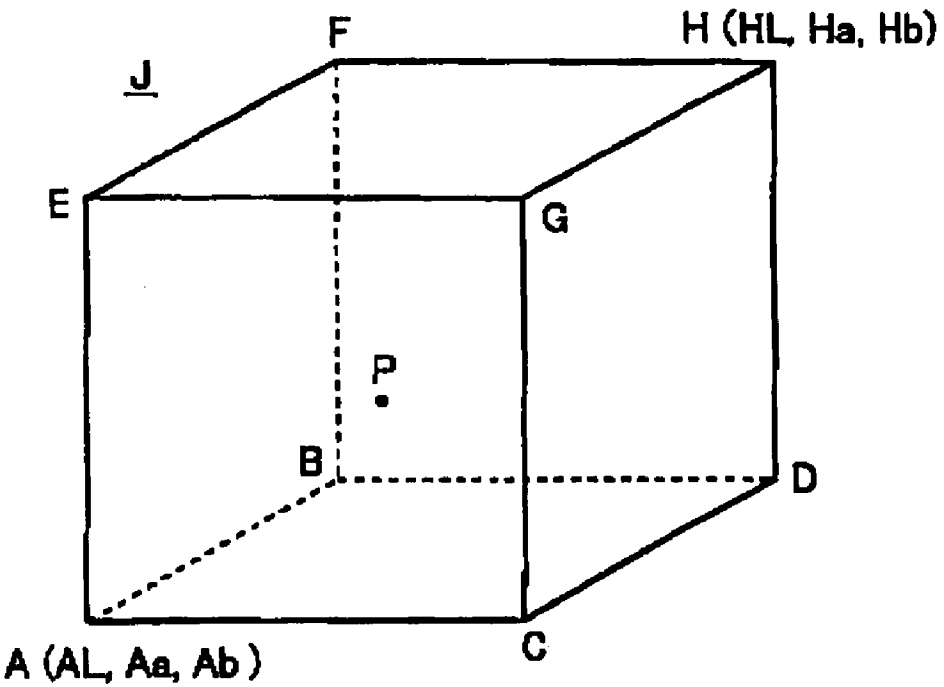
FIG. 7(*a*) is an explanatory diagram showing a small space J in a three-dimensional space W.
Figure 7A:
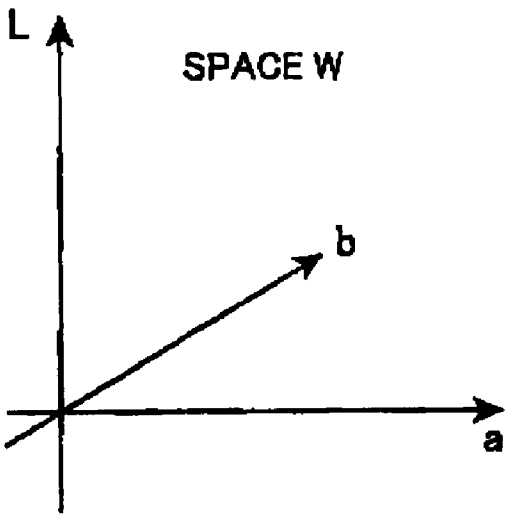
Figure 7B:
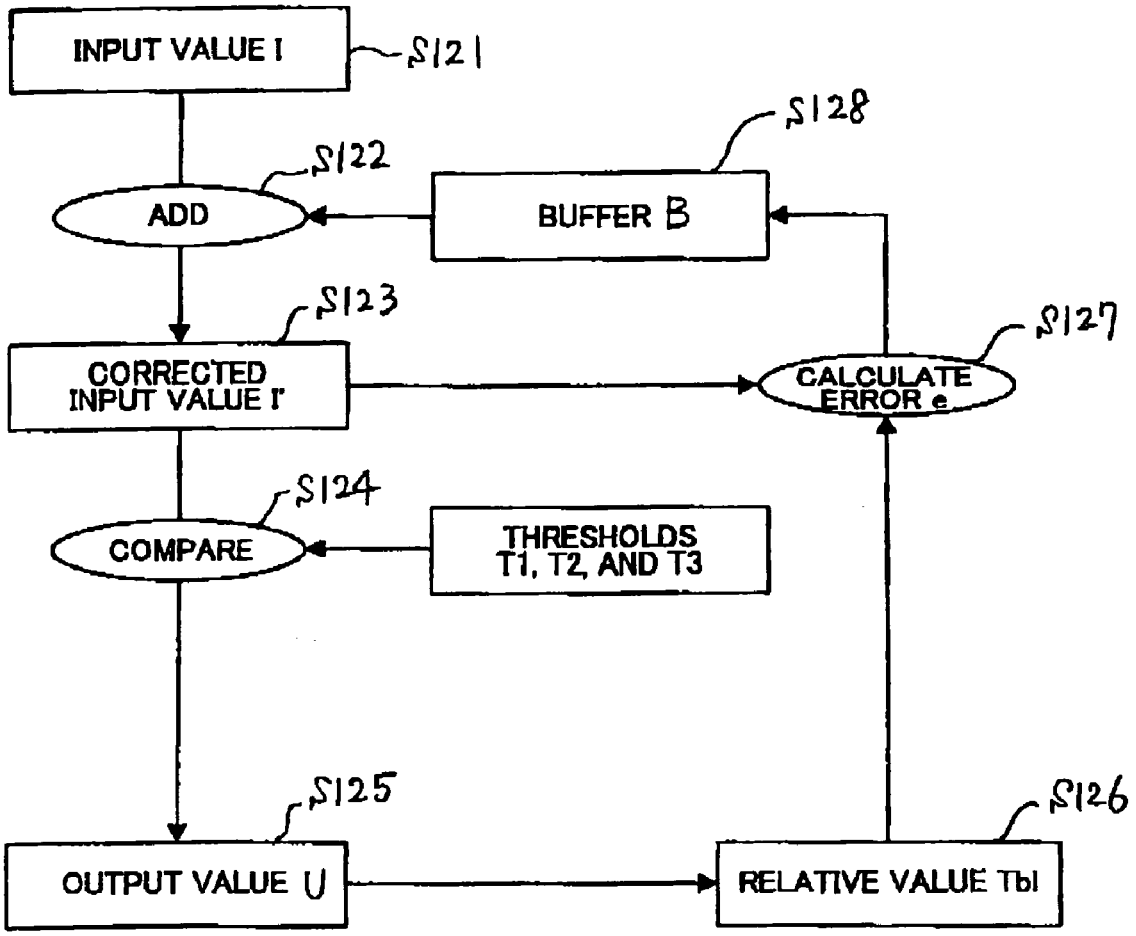

Next, the Lab signals are converted to C, M, Y, and K signals. Specifically, as shown in FIG. 7(*a*), we assume a space W exists with three axes L, a, and b orthogonal to each other and divide the space W into equal intervals of a desired length. Each partition space will be called a small space J. Note that, only one small space J is shown in FIG. 7(*a*) for explanatory purposes. Output values (CMYK values) are pre-stored in memory for inputted Lab values at each vertex in the small space J (A, B, C, D, E, F, G, H, etc.). The set of CMYK values at all vertices in the space W is stored in the ROM 57 as profile data.

When arbitrary Lab values (hereinafter referred to as an input value P) are given, the controller 60 determines which small space J contains the input value P. Next, the controller 60 finds the CMYK values for each vertex of the small space J from the profile data. Here, CMYK values at each vertex will be referred to as (Ac, Am, Ay, Ak), (Bc, Bm, By, Bk), (Cc, Cm, Cy, Ck), (Dc, Dm, Dy, Dk), (Ec, Em, Ey, Ek), (Fc, Fm, Fy, Fk), (Gc, Gm, Gy, Gk), and (Hc, Hm, Hy, Hk). Further, Lab values for the input value P will be referred to as (PL, Pa, Pb); Lab values at the vertex A as (AL, Aa, Ab); and Lab values at the vertex H as (HL, Ha, Hb). Similarly, vertices B, C, D, E, F, and G will also be expressed with the predetermined letters L, a, b added.

Next, interpolation is performed according to equations (10)-(13) in order to calculate the CMYK values for the input value P, that is, values Pc, Pm, Py, and Pk.

$$Pc=KA*Ac+KB*Bc+KC*Cc+KD*Dc+KE*Ec+KF*Fc+KG*Gc+KH*Hc \quad (10)$$

$$Pm=KA*Am+KB*Bm+KC*Cm+KD*Dm+KE*Em+KF*Fm+KG*Gm+KH*Hm \quad (11)$$

$$Py=KA*Ay+KB*By+KC*Cy+KD*Dy+KE*Ey+KF*Fy+KG*Gy+KH*Hy \quad (12)$$

$$Pk=KA*Ak+KB*Bk+KC*Ck+KD*Dk+KE*Ek+KF*Fk+KG*Gk+KH*Hk \quad (13)$$

Here, KA, KB, KC, KD, KE, KF, KG, and KH are weighted coefficients calculated by the following equations (14)-(21).

$$KA=(TL-SL)*(Ta-Sa)*(Tb-Sb)/(TL*Ta*Tb) \quad (14)$$

$$KB=(TL-SL)*(Ta-Sa)*Sb/(TL*Ta*Tb) \quad (15)$$

$$KC=(TL-SL)*Sa*(Tb-Sb)(TL*Ta*Tb) \quad (16)$$

$$KD=(TL-SL)*Sa*Sb/(TL*Ta*Tb) \quad (17)$$

$$KE=SL*(Ta-Sa)*(Tb-Sb)/(TL*Ta*Tb) \quad (18)$$

$$KF=SL*(Ta-Sa)*Sb/(TL*Ta*Tb) \quad (19)$$

$$KG=SL*Sa*(Tb-Sb)/(TL*Ta*Tb) \quad (20)$$

$$KH=SL*Sa*Sb/(TL*Ta*Tb) \quad (21)$$

Here, TL=HL−AL, Ta=Ha−Aa, and Tb=Hb−Ab, which indicate distances between vertex A and vertex H in the small space J in the directions L, a, and b. Further, SL=PL−AL, Sa=Pa−Aa, and Sb=Pb−Ab. These values indicate distances from a primary surface on the small space J to the input value P in the L, a, and b directions.

After converting signals in the RGB color system to CMYK signals as described above, the process advances to S120. In S120, the controller 60 creates multilevel data based on the image data by pseudo-gradation process. The image data are 8-bit, 256-tone data, while the multilevel data are 2-bit, 4-tone data. Thus, an error diffusion method well known in the art is used to maintain the overall density.

The error diffusion method will be described next with reference to FIG. 7(*b*). First, in S121, the controller 60 extracts an input value I for a target pixel from the image data. In S122 and S123, the controller 60 obtains a corrected input value I' by adding a buffer B generated from pixels surrounding the target pixel to the input value I (I'=I+B).

The buffer B is calculated as follows. In S126, the controller 60 finds a relative density value Tbl from output values U (S125) calculated according to a method described below for each surrounding pixel by converting a density indicated by the output values U into an input value I. Next, in S127 the controller 60 calculates a density error e from the relative density value Tbl (S126) and the corrected input value I' (S123) (e=I'−Tbl) In S128, the controller 60 multiples the error e by a coefficient determined from positional relationship between the target pixel and the surrounding pixel to find a weighted error e', and obtains the buffer B by accumulating the weighted errors e' for all surrounding pixels (B=Σe').

In S123, the controller 60 adds the buffer B to the input value I to obtain the corrected input value I'. In S124, the controller 60 compares the corrected input value I' with three thresholds T1, T2, and T3 (where T1<T2<T3) that are stored in the ROM 57. If I'<T1, the controller 60 sets the output value U to "none", which is the lowest density of the four tones. If T1<I'<T2, the output value U is set to "small", which is the third highest density among the four tones. If T2<I'<T3, the output value U is set to "medium", which is the second highest density among the four tones. If T3<I', the output value U is set to "large", which is the highest density among the four tones. The "large" density is three times the "small" density, and the "medium" density is two times the "small" density. After creating multilevel data according to the process described above, the process advances to S130 of FIG. 6.

In S130 the controller 60 performs a dot layout control process based on the multivalue data, and generates dot layout data. Dot layout data describes the dot size at each pixel and is used when executing a printing operation described later. The dot layout control process will be described later.

In S140 the controller 60 transfers the dot layout data to the printing unit 3.

In S150 the printing unit 3 performs a printing process (FIG. 4) in which the paper conveying mechanism 63 conveys the recording paper and the recording head 41 ejects ink droplets based on the dot layout data while the carriage 39 moves reciprocatingly. More specifically, when forming an image, the controller 60 controls the printing unit 3 to change the size of the ink droplets ejected by the recording head 41 for each pixel based on the "none", "small", "medium", and "large" values recorded for each pixel in the dot layout data. In order to perform multipass recording described later, the dot layout data includes three passes worth of data (multipass data) for each line. Accordingly, the recording head 41 scans three times for each line.

(d) Next, the dot layout control process will be described with reference to FIGS. 8 to 18(*d*).

Figure 8:
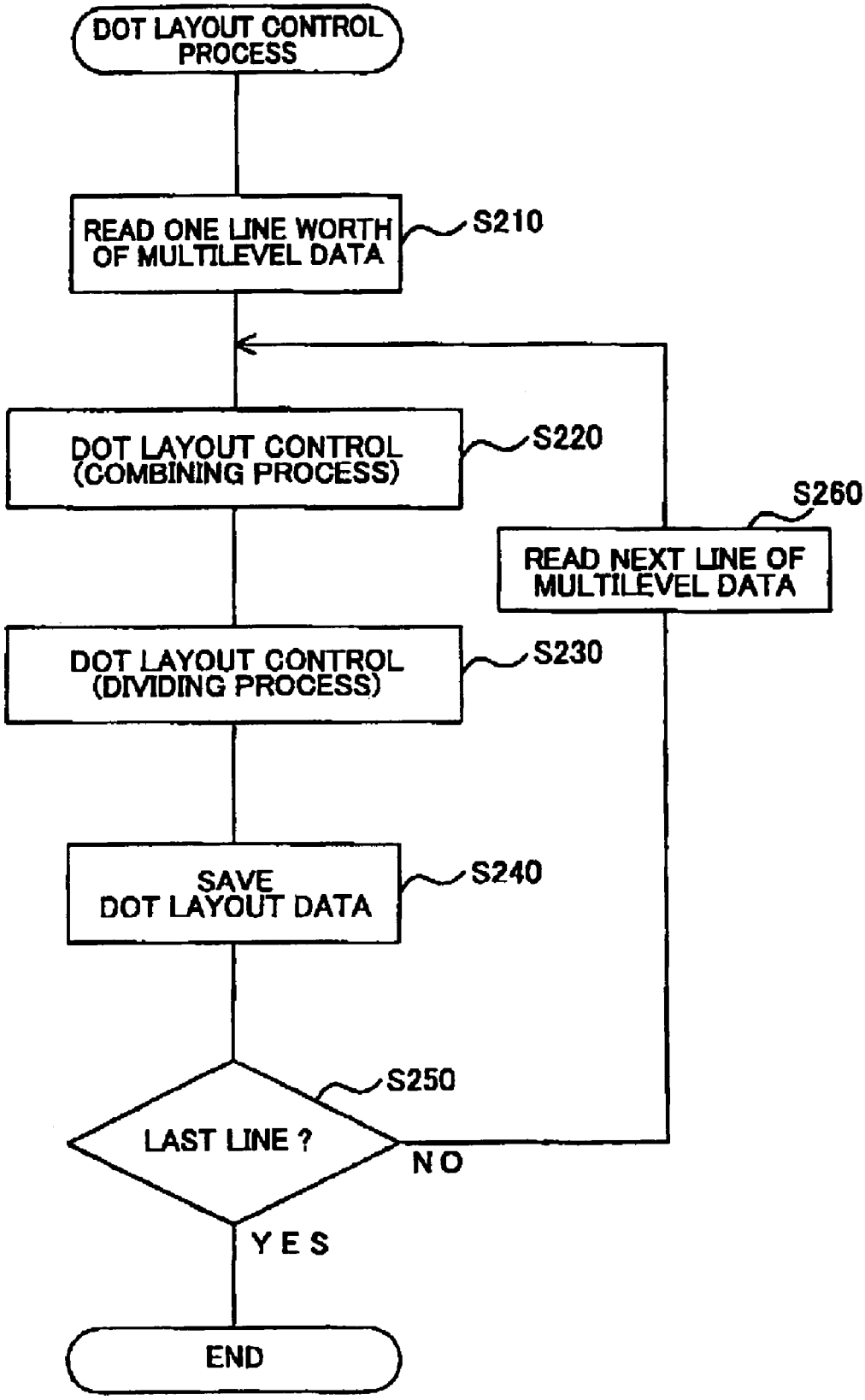
FIG. 8 is a flowchart showing the steps in a dot layout control process.

FIG. 8 is a flowchart showing the steps in the dot layout control process. In S210 of FIG. 8, the controller 60 reads the first line of multilevel data.

In S220 the controller 60 performs a combining process. The combining process will be described with reference to FIGS. 9 to 12.

Figure 9:
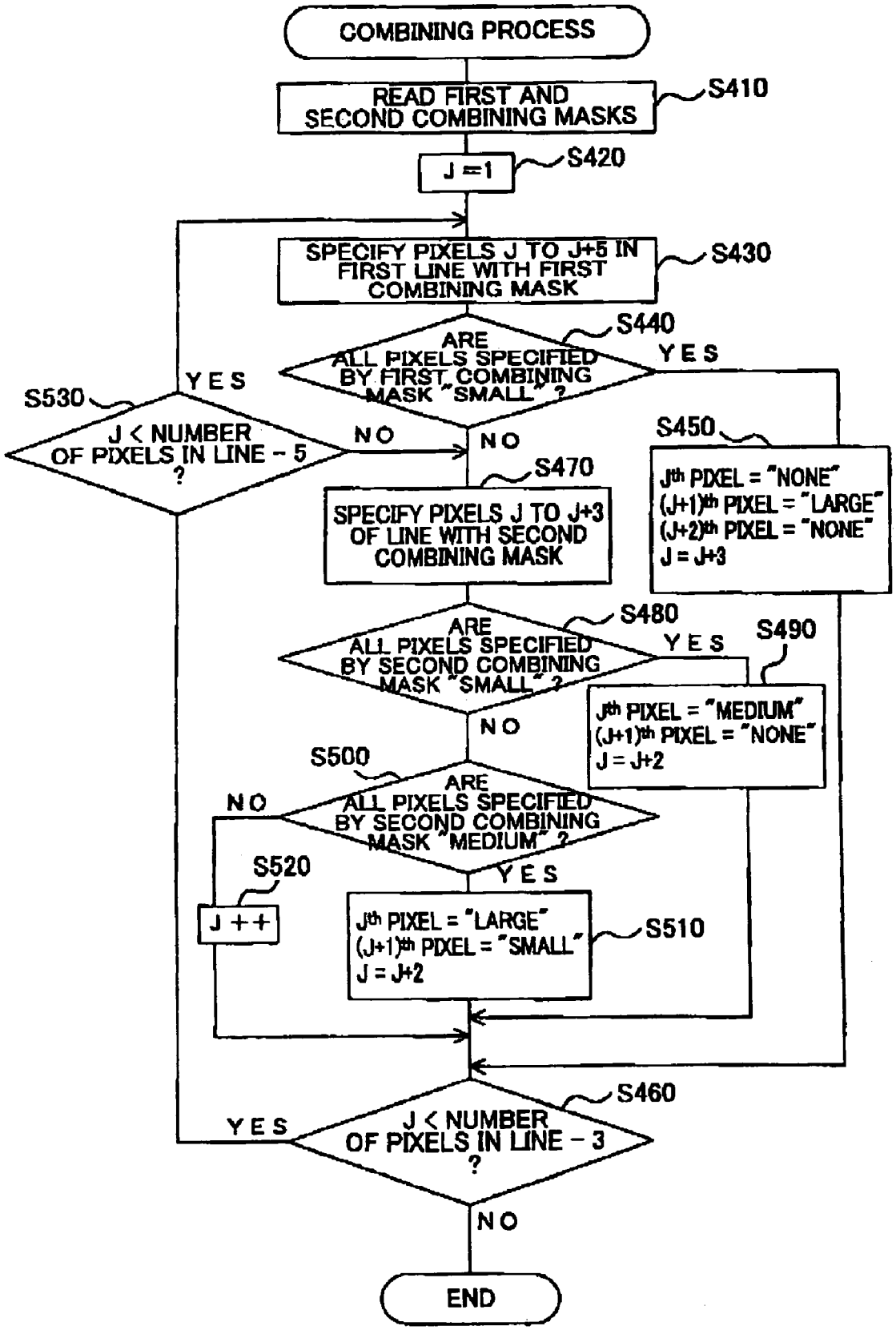
FIG. 9 is a flowchart showing the steps in a combining process.

FIG. 9 is a flowchart showing the steps in the combining process. In S410 the controller 60 reads a first combining mask and second combining mask from the RON 57. The first combining mask specifies six (6) consecutive pixels in one line of the multilevel data. The second combining mask specifies four (4) consecutive pixels in one line of the multilevel data.

In S420 the controller 60 initializes an identifier J to "1". The identifier J indicates the pixel number in the line of multilevel data read in S210 (FIG. 8).

Figure 10:
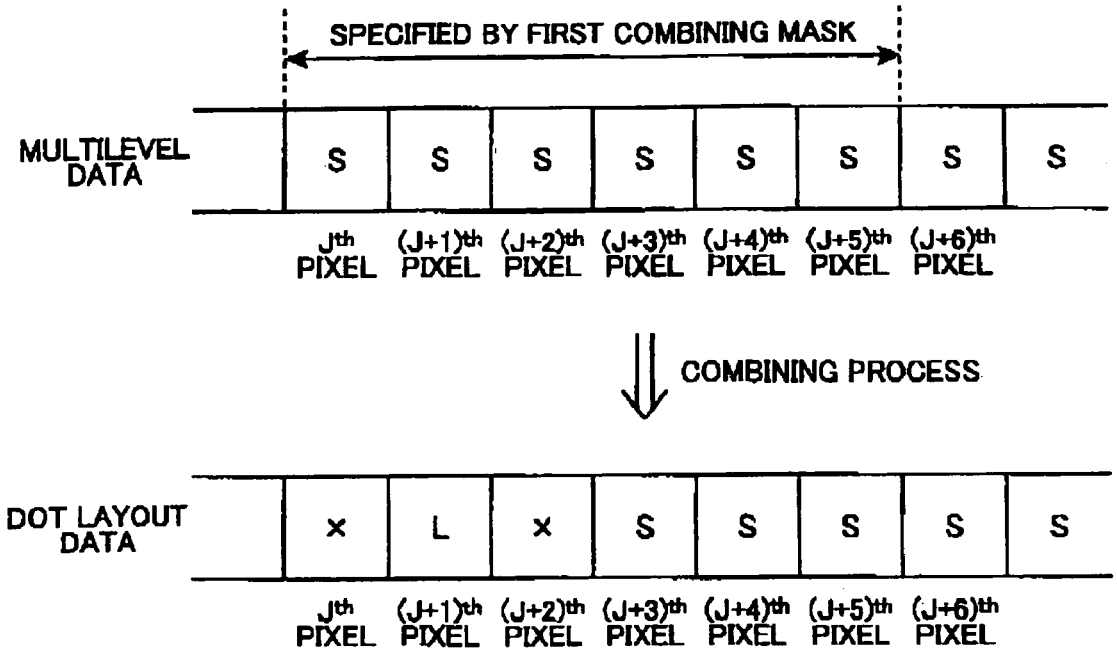
FIG. 10 is an explanatory diagram illustrating the combining process in which small dots are combined by a first combining mask.

In S430, as shown in FIG. 10, the controller 60 sets the Jth pixel in the line of multilevel data as the target pixel, and specifies pixels from the Jth pixel to the (J+5)th pixel by the first combining mask.

In S440 the controller 60 determines whether the pixels specified by the first combining mask are all small dots. If all the pixels are small dots (S440: YES), the process advances to S450. If not (S440: NO), the process advances to S470.

In S450 the controller 60 records the dot layout data such that the Jth pixel is set to "none", the (J+1)th pixel to "large", and the (J+2)th to "none". As mentioned earlier, a "large" dot is three times the size of a "small" dot. In FIGS. 10 to 18(*d*), a pixel set to "none" is represented as "X". Similarly, a pixel set to "small" is represented as "S". A pixel set to "medium" is represented as "M". A pixel set to "large" is represented as "L".

In other words, in S450 a combined dot formed by combining dots for the three pixels J to (J+2) in a line of multilevel data is recorded for the (J+1)th pixel.

Also in S450, J is incremented by three, and the process advances to S460.

In S460 the controller 60 determines whether the following inequality (22) is true.

$$J<\text{Number of pixels in a line}-3 \quad (22)$$

If the inequality in S460 is not true (S460: NO), the process ends and the controller 60 returns to S230 in FIG. 8. If the inequality in S460 is true (S460: YES), the controller 60 advances to S530.

Figure 11:
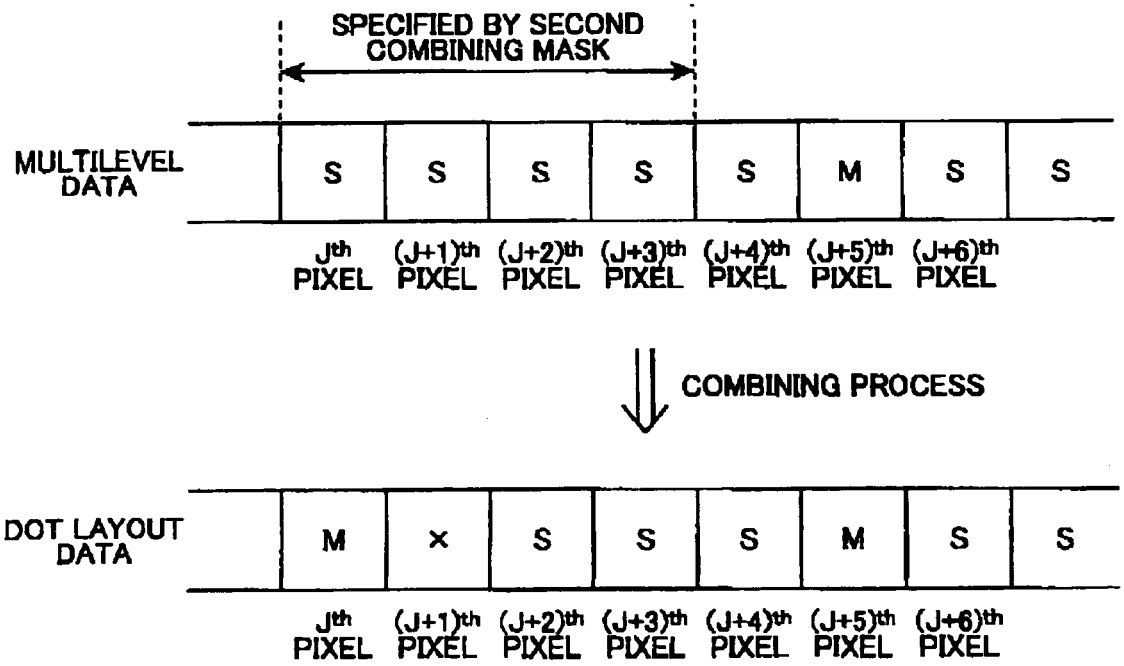
FIG. 11 is an explanatory diagram illustrating the combining process in which small dots are combined by a second combining mask.

However, if the controller 60 determines in S440 that not all pixels specified by the first combining mask are small (S440: NO), then in S470, as shown in FIG. 11, the controller 60 specifies four pixels from the Jth pixel to the (J+3)th pixel by the second combining mask.

In S480 the controller 60 determines whether all pixels specified by the second combining mask are small dots. If all pixels are small dots (S480: YES), the process advances to S490. If not (S480: NO), the process advances to S500.

In S490 the controller 60 records dot layout data such that the Jth pixel is set to a medium dot, and the (J+1)th pixel to "none". As mentioned earlier, a medium dot is twice the size of a small dot.

Hence, in S490 a combined dot formed by combining dots for the two pixels J and J+1 on the line of multilevel data is recorded for the Jth pixel.

Also in S490, J is incremented by two, and the process advances to S460.

However, if the controller 60 determines in S480 that not all pixels specified by the second combining mask are "small" (S480: NO), then in S500 the controller 60 determines whether all pixels specified by the second combining mask are medium dots. If all pixels are medium dots (S500: YES), then the process advances to S510. If not (S500: NO), then in S520 J is incremented by just one, and the process advances to S460.

Figure 12:
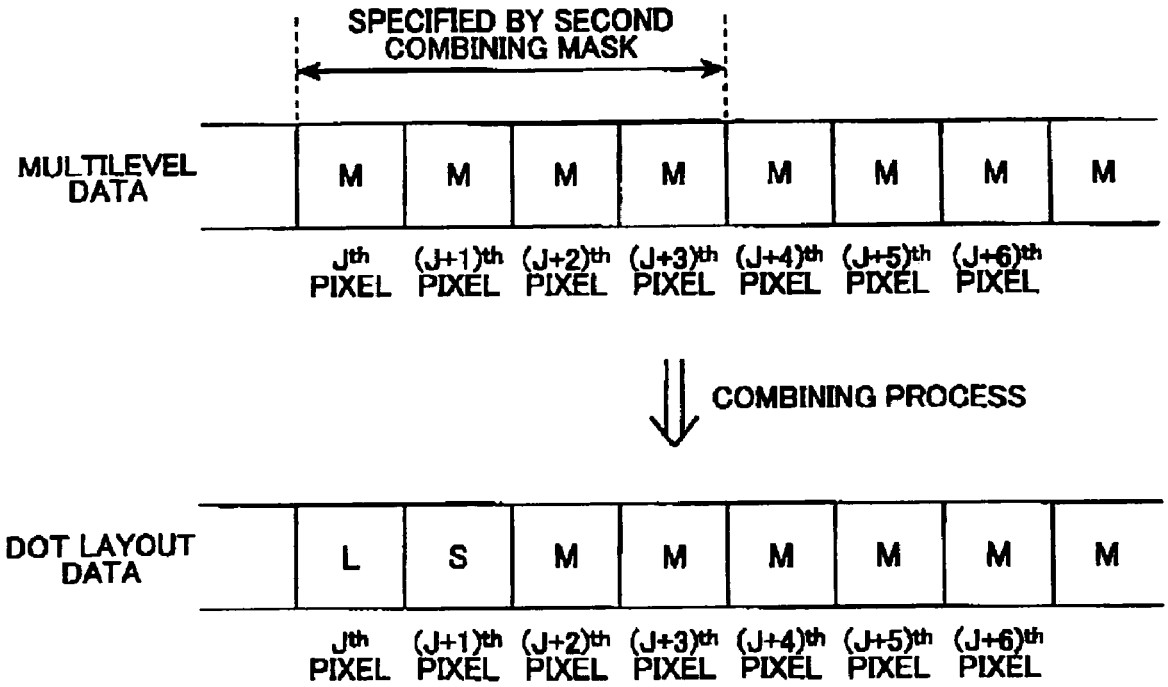
FIG. 12 is an explanatory diagram illustrating the combining process in which medium dots are combined by the second combining mask.

In S510, as shown in FIG. 12, the controller 60 records dot layout data such that the Jth pixel is set to a large dot, and the (J+1)th pixel is set to a small dot.

If the controller 60 determines that the inequality in S460 is true (S460: YES), then in S530 the controller 60 determines whether the inequality (23) is true.

$$J<\text{Number of pixels in a line}-5 \quad (23)$$

If the inequality in S530 is true (S530: YES), then the process advances to S430. If not (S530: NO), the process advances to S470.

In the combining process of the present embodiment, dots are combined only when a YES determination is made in steps S440, S480, and S500, as described above. Accordingly, a combined dot is created by combining only a portion of dots in the line of multilevel data.

In the dot layout data created during the combining process of the present embodiment, the total dot size prior to combination is equivalent to the dot size after combination. For example, in S450 three small dots are combined to form one large dot. Since one large dot is equivalent to three dots, the total dot size prior to combination is equivalent to the dot size after combination.

Further, in S510 two medium dots are combined to form one large dot and one small dot. Since one medium dot is equivalent to two small dots, the total dot size prior to combination is equivalent to the dot size after combination.

The dot size in the dot layout data is proportionate to the ink ejection amount, the surface area occupied by ink ejected onto the recording medium, and the average density of ink ejected onto the recording medium.

Accordingly, the total amount of ink ejected according to the dots prior to combination is equivalent to the amount of ink ejected according to the combined dot. Further, the total amount of surface area occupied by the ink ejected onto the recording paper according to the dots prior to combination is equivalent to the total surface area occupied by ink ejected according to the combined dot. Further, the average density of ink ejected onto the recording paper according to dots prior to combination is equivalent to the average density of ink ejected according to the combined dot.

The combining process of the present embodiment may also include a step for determining whether the dot density near the target pixel (for example, the number of dots within a circle of a certain radius around the target pixel) is greater than or equal to a predetermined value. In this case, the controller 60 executes the combining process described above only when the dot density near the target pixel is at least the predetermined value and does not execute the combining process when the dot density is less than the predetermined value. Since combined dots are only created when the dot density near the target pixel is greater than or equal to the predetermined value, combined dots are not likely to appear as granules that can give the image a grainy appearance.

Here, the "predetermined value" that serves as a reference for the dot density near the target pixel can be varied according to the size of the combined dot to be created. Specifically, the predetermined value can be set to a large value when the size of the combined dots to be created are large, because such dots tend to generate a grainy appearance, and can be set small when the size of the combined dot to be created is small, because smaller combined dots are not likely to appear grainy even when the surrounding area has a low dot density. Thus, it is possible to produce only combined dots of a size that is difficult to see in the density area, thereby reducing graininess.

In the combining process of the present embodiment, dots are combined such that dot density of combined dots falls within a density range in which the combined dots are not easily visible. More specifically, in the present embodiment, small dots are combined into a large dot only when the controller 60 determined that the number of small dots is greater than or equal to a predetermined number (such as six pixels), rather than when the controller 60 determined that the number of small dots is equivalent to a large dot (such as three pixels). In the present embodiment, six consecutive small dots are required to be combined into one large dot, and three consecutive small dots are not sufficient (S430, S440). Accordingly, the average density of surrounding pixels when forming a large dot can be kept equal to or greater than a predetermined density. Thus, the amount of graininess in the recorded image can be reduced.

After completing the combining process, the controller 60 returns to the dot layout control process in FIG. 8 and advances to S230. In S230 the controller 60 performs a dividing process on the dot layout data created in S220 to update the dot layout data. The dot layout data updated in S230 includes first to third passes worth of dot layout data to support multipass recording. Next, the process of S230 will be described in detail with reference to FIGS. 13 to 18(*d*).

Figure 13:
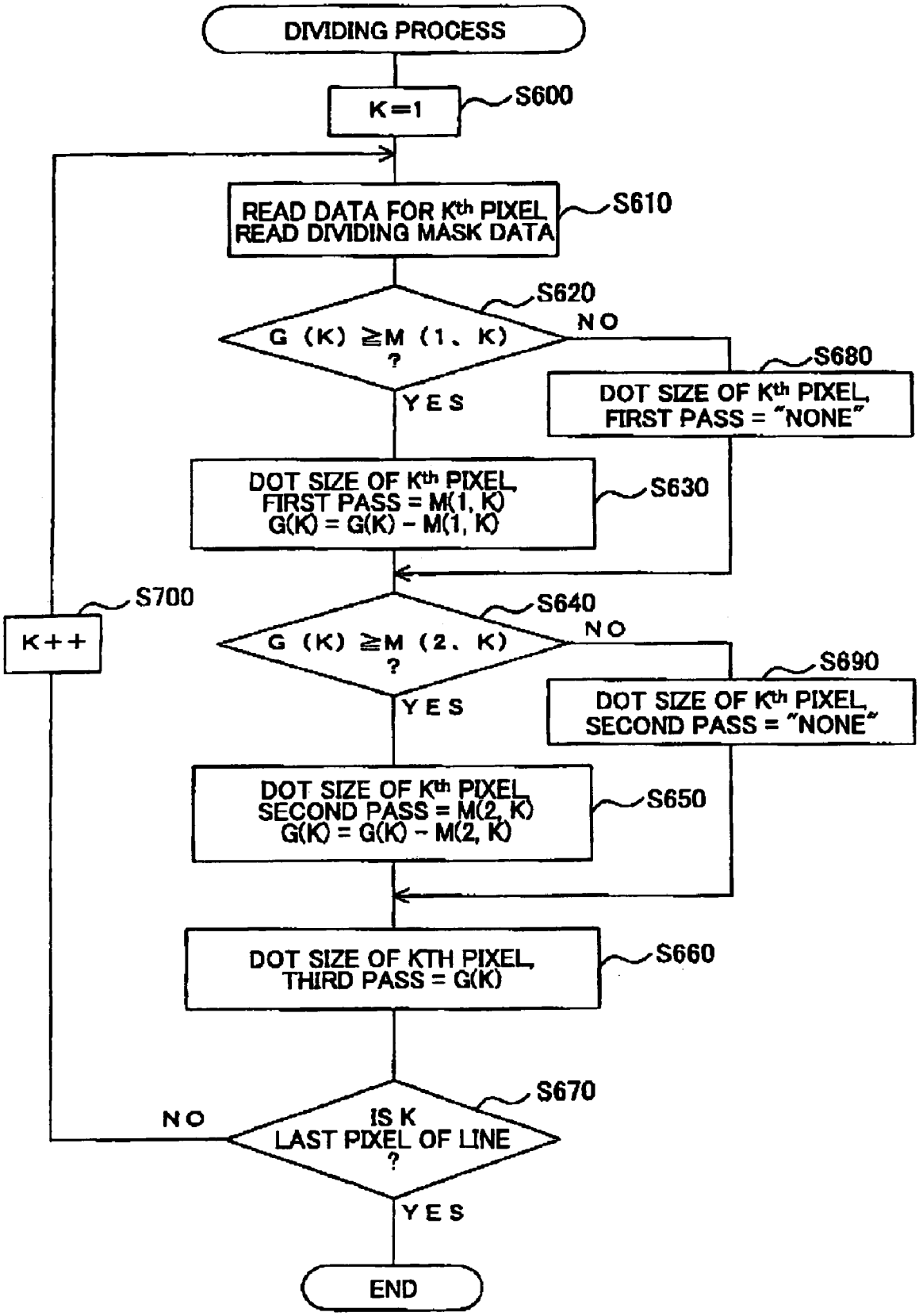
FIG. 13 is a flowchart showing the steps in a dividing process.
Figure 19:
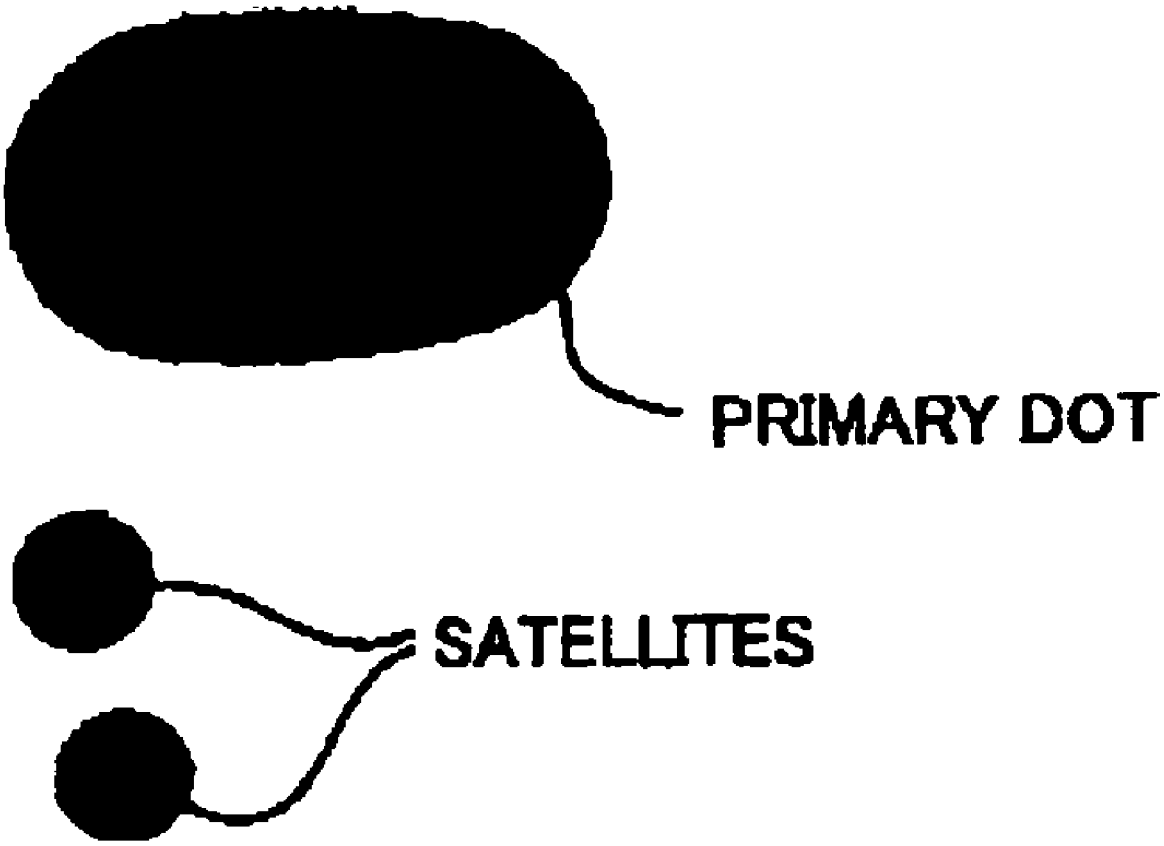
FIG. 19 is an explanatory diagram showing satellites generated using a conventional printing method.

FIG. 13 is a flowchart showing the steps in the dividing process of S230 (FIG. 8). In S600 the controller 60 initializes a variable K indicating the pixel position in a line to "1".

In S610 the controller 60 reads data for the Kth pixel from the dot layout data that was created in the combining process of FIG. 9. Also in S610, the controller 60 reads dividing mask data from the ROM 57. As shown in FIG. 14(*a*), the dividing mask data is separated into a line for the first pass, a line for the second pass, and a line for the third pass. These lines are further divided into eighteen columns to specify eighteen continuous pixels in a single line of multilevel data. In each cell of the dividing mask is recorded data corresponding to the dot size, such as "X" (denoting "none" and signifying that an ink droplet is not ejected), "S" (a small ink droplet is ejected), "M" (a medium ink droplet is ejected), and "L" (a large ink droplet is ejected).

Dots recorded in the three cells of any column in the dividing mask data for the first pass, second pass, and third pass total the equivalent of one large dot (in other words, 1.5 medium dots or 3 small dots).

FIG. 14(*b*) shows ten different combinations for the three cells in one column that meets the above condition. The dividing mask in FIG. 14(*a*) was created by suitably arranging these ten combinations. For example, the ten combinations can be arranged randomly. Or, the first column from the left (S, S, S), the second column (S, M, X), and the third column (M, S, X) can be arranged more than the other columns, such that dots will be divided as much as possible. Alternatively, the ten combinations can be arranged evenly, such that dots will be divided with as many patterns as possible.

In S620 of FIG. 13, the controller 60 sets pixel data G(K) to the dot size recorded in the Kth pixel data read in S610. Then the controller 60 compares the G(K) with dot size M(1,K) recorded in the column corresponding to the Kth pixel in the first pass row of the dividing mask and determines whether the following inequality (24) is true.

$$G(K) \geqq M(1,K) \tag{24}$$

If inequality (24) is true (S620: YES), then the process advances to S630. If not (S620: NO), the process advances to S680. When $(18L+1) \leqq K < (18L+19)$, the column corresponding to the Kth pixel in the first pass row of the dividing mask is the (K−18L)th column, where L is an integer greater than or equal to zero. That is, since the number of columns in the dividing mask (18) is smaller than the number of pixels in a single line of multilevel data, one column in the dividing mask corresponds to a plurality of pixels in the multilevel data.

In S630 the controller 60 records the value of M(1,K) as the dot size for the Kth pixel in the first pass of the dot layout data. Also in S630, the controller 60 updates the pixel data G(K) for the Kth pixel according to the following equation (25).

$$G(K) = G(K) - M(1,K) \tag{25}$$

In S640 the controller 60 compares G(K) with the dot size M(2,K) for the column corresponding to the Kth pixel in the second pass row of the dividing mask and determines whether the following inequality (26) is true.

$$G(K) \geqq M(2,K) \tag{26}$$

If inequality (26) is true (S640: YES), then the process advances to S650. If not (S640: NO), the process advances to S690.

In S650 the controller 60 records the value of M(2,K) as the dot size for the Kth pixel in the second pass of the dot layout data. Also in S650, the controller 60 updates the pixel data G(K) for the Kth pixel according to the following equation (27).

$$G(K)=G(K)-M(2,K) \quad (27)$$

In S660 the controller 60 records G(K) as the dot size for the Kth pixel in the third pass of the dot layout data.

In S670 the controller 60 determines whether the pixel position K is the last pixel in the line of dot layout data. If K is the last pixel (S670: YES), then the process returns to the dot layout control process in FIG. 8 and advances to S240. If not (S670: NO), the process advances to S700.

On the other hand, if the expression (24) is determined to be not true in S620 (S620: NO), then in S680 the controller 60 records "none" (no dot formation) in the Kth pixel of the first pass in the dot layout data. Subsequently, the process advances to S640.

Further, if expression (26) is determined to be not true in S640 (S640: NO), then in S690 the controller 60 records a "none" (no dot formation) in the Kth pixel for the second pass of the dot layout data. Subsequently, the process advances to S660.

Further, if the controller 60 determines in S670 that K is not the last pixel in the line (S670: NO), then in S700 K is incremented by one, and the process advances to S610. In this way, the dividing process of the present embodiment divides the dot for the Kth pixel in the dot layout data into a plurality of dots of a smaller size and records over the first through third pass data.

In this dividing process, the total dot size of divided dots formed by dividing a single dot is equivalent to the size of the dot prior to division. Since the dot size in the dot layout data is proportionate to the amount of ink ejected, the total amount of ink ejected according to the divided dots is equivalent to the amount of ink that would be ejected according to the dot prior to division.

Further, since the dot size in the dot layout data is proportionate to the surface area occupied by ink ejected onto the recording paper, the total surface area of ink ejected according to the divided dots is equivalent to the surface area of ink that would be ejected according to the dot prior to division.

Further, since the dot size in the dot layout data is proportionate to the average density of ink ejected onto the recording paper, the average density of ink ejected according to the divided dots is equivalent to the average density of ink that would be ejected according to the dot prior to division.

In S620 of FIG. 13 in the dividing process of the present embodiment, when G(K)>M(1,K) and M(1,K) is either "small" or "medium", then either a divided small or medium dot is placed in the first pass in S630. Accordingly, when M(1,K) is "none" or "large", then a divided dot is not placed in the first pass. Similarly, when M(2,K) is either "none" or "large", neither a divided small nor medium dot is placed in the second pass.

Accordingly, in the example mask of FIG. 14(*a*), dot division is not performed for pixels corresponding to columns having a combination of "none" and "large" dot sizes for the first through third passes (cells 2, 4, 6, 8, 10, 12, 14, 16, and 18 in the example of FIG. 14(*a*)). Hence, only a portion of the dots is divided in the present embodiment.

When a single dot is divided into two or more dots that are recorded in a plurality of passes in the dot layout data, the ink droplets ejected based on this plurality of divided dots are recorded at substantially the same location on the recording paper during the printing process (S150 of FIG. 6).

When dot layout data undergoes the dividing process of the present embodiment, fewer dots are arranged in the second and third pass data in comparison with the first pass data, as is illustrated in FIGS. 15(*a*) to 17(*c*). Therefore, the recording density of the second and third pass data differs from that of the first pass data. Here, the recording density for each pass can be adjusted by varying the configuration of the dividing mask. Specifically, the recording density for each pass can be adjusted based on how the combinations shown in FIG. 14(*b*) are arranged in the dividing mask.

Since the recording density for the second and third passes in the dot layout data is less than the recording density for the first pass, as described above, the recording speed of the recording head 41 in the present embodiment is set faster for the second and third passes than for the first pass.

FIGS. 15(*a*) to 15(*c*) show one example when executing the dividing process. In this example, the dot layout data prior to performing the dividing process (FIG. 15(*b*)) includes only small dots in succession.

When focusing on the first pixel in the dot layout data prior to division, the initial pixel data G(1) is set to "small", since the dot size is "small". However, since the dot size M(1,1) for the first pass and first column in the dividing mask (FIG. 15(*a*)) is also "small", a YES determination is made in S620 of FIG. 13.

Accordingly, in S630 the controller 60 sets the dot size for the first pixel in the first pass of the dot layout data to M=1,1)="small". In addition, the controller 60 updates G(1) to "none" after subtracting the value of M(1,1), which is "small". That is, G(1)=G(1)−M(1,1)="small"−"small"="none".

Next, the controller 60 compares the size of the G(1) and M(2,1) in S640. Since G(1) has been updated to "none" in S630 and M(2,1) is "Small" (FIG. 15(*a*)), G(1)<M(2,1). Therefore, a NO determination is made in S640 and the process advances to S690. In S690 the controller 60 sets the dot size for the first pixel in the second pass of the dot layout data to "none". In S660 the controller 60 sets the dot size for the first pixel in the third pass of the dot layout data to G(1). Since G(1) was updated to "none" in S630, as described above, the dot size for the first pixel in the third pass of the dot layout data is ultimately set to "none". The controller 60 performs the dividing process similarly for the remaining pixels beginning from the second pixel.

FIGS. 16(*a*) to 16(*c*) illustrate another example of the dividing process. In this example, the dot layout data prior to performing the dividing process (FIG. 16(*b*)) includes only medium dots in succession.

When focusing on the first pixel in the dot layout data prior to division (FIG. 16(*b*)), the initial pixel data G(1) is set to "medium", since the dot size is "medium". However, since the dot size M(1,1) for the first pass and first column in the dividing mask (FIG. 16(*a*)) is "small", G(1)>M(1,1). Hence, a YES determination is made in S620 of FIG. 13.

Accordingly, in S630 the controller 60 sets the dot size for the first pixel in the first pass of the dot layout data to M(1,1)="small". The controller 60 updates G(1) to "small" after subtracting the value of M(1,1), which is "small". That is, G(1)=G(1)−M(1,1)="medium"−"small"="small".

Next, the controller 60 updates the sizes of G(1) in S630 and compares with M(2,1) in S640. Since G(1)="small" and M(2,1)="small", a YES determination is made in S640 and the process advances to S650.

In S650 the controller 60 sets M(2,1) as the dot size for the first pixel in the second pass of the dot layout data. Since the value of M(2,1) is "small", the controller 60 sets the dot size for the first pixel in the second pass of the dot layout data to "small". In addition, the controller 60 updates G(1) to "none" after subtracting the value of M(2,1), which is "small". That is, G(1)=G(1)−M(2,1)="small"−"small"="none".

In S660 the controller 60 sets the dot size for the first pixel in the third pass of the dot layout data to G(1). Since G(1) was updated to "none" in S650, as described above, the dot size for the first pixel in the third pass is ultimately set to "none". The controller 60 performs the dividing process similarly for the remaining pixels beginning from the second pixel.

FIGS. 17(*a*) to 17(*c*) illustrate another example of the dividing process. In this example, the dot layout data prior to performing the dividing process (FIG. 17(*b*)) includes only large dots in succession.

When focusing on the first pixel in the dot layout data prior to division, the initial pixel data G(1) is set to "large", since the dot size is "large". However, the dot size M(1,1) for the first pass and first column in the dividing mask (FIG. 17(*a*)) is "small". Accordingly, G(1)≧M(1,1), and a YES determination is made in S620 of FIG. 13.

Hence, in S630 the controller 60 sets the dot size for the first pixel in the first pass of the dot layout data to M(1,1)="small". In addition, the controller 60 updates G(1) to "medium" after subtracting the value of M(1,1), which is "small". That is, G(1)=G(1)−M(1,1)="large"−"small"="medium".

In S640, the controller 60 compares the sizes of G(1) updated in S630 with M(2,1). Since G(1)="medium" and M(2,1)="small", a YES determination is made in S640 and the process advances to S650.

In S650 the controller 60 sets M(2,1) as the dot size for the first pixel in the second pass of the dot layout data. Since the value of M(2,1) is "small", the dot size for the first pixel in the second pass is set to "small". In addition, the controller 60 updates G(1) to "small" after subtracting the value of M(2,1), which is "small". That is, G(1)=G(1)−M(2,1)="medium"−"small"="small".

In S660 the controller 60 sets the dot size for the first pixel in the third pass of the dot layout data to G(1). Since G(1) was updated to "small" in S650, as described above, the dot size for the first pixel in the third pass is ultimately set to "small". The controller 60 performs the dividing process similarly for the remaining pixels beginning from the second pixel.

The dividing mask used for the dividing process is not limited to the masks shown in FIGS. 14(*a*) to 17(*a*), but may be a mask such as that shown in FIG. 18(*a*). As shown in FIG. 18(*b*), when executing the dividing process on data including a succession of small dots, this dividing mask can prevent a succession of small dots from being generated for a single pass. Further, as shown in FIG. 18(*c*), when executing the dividing process on data including a succession of medium dots, this dividing mask can prevent a succession of medium dots being generated for a single pass. Further, as shown in FIG. 18(*d*), when executing the dividing process on data including a succession of large dots, this dividing mask can prevent a succession of large dots from being generated for a single pass.

After the dividing process is completed, the process returns to the dot layout control process in FIG. 8 and advances to S240. In S240 the controller 60 stores the dot layout data in the RAM 59 (FIG. 5). In S250 the controller 60 determines whether all lines of the multilevel data have been read, in other words, whether the last line has been read. If all lines have been read (S250: YES), the process ends. If not (S250; NO), the process advances to S260.

In S260 the controller 60 reads the next line of multilevel data and advances to S220.

(e) Next, the effects obtained by the multifunction device 1 according to the present embodiment will be described.

(i) In the dot layout control process according to the above-described embodiment, processes are performed for combining and dividing dots so that the dot layout data does not include successions of dots of the same size exceeding a predetermined value. Accordingly, the recording head 41 does not eject dots of the same size in succession or continuously for more than the predetermined value, thereby suppressing noise that is dependent on droplet size.

When creating the dot layout data by using the dividing mask, the predetermined number can be modified by changing selection and arrangement of the combinations in FIG. 14(*b*), that is, how the combinations are selected and arranged.

When creating the dot layout data by using the combining mask, the predetermined number can be changed by changing the number of pixels specified by the combining mask. In the above-described embodiment, the first combining mask specifies six consecutive pixels and the second combining mask specifies four consecutive pixels. However, the number of pixels specified by the combining masks may be changed according to situations.

For example, the predetermined value may be the number of pixels in one line of multilevel data. In this case, the recording head 41 does not record an entire line with dots of the same size, but mixes at least one dot of a different size in the line.

(ii) In the dot dividing process of the above-described embodiment, dots are divided into a plurality of dots of a smaller size, thereby increasing the dot density and enabling the formation of images in high detail.

(iii) In the above-described embodiment, dot layout data is created using a combining mask and a dividing mask, thereby facilitating the creation of dot layout data.

(iv) In the above-described embodiment, only a portion of dots in a line of multilevel data undergoes combining and dividing processes. Accordingly, the dot layout data includes a mixture of dots that have undergone combining and division and dots that have not been changed. In other words, the dot layout data includes a mixture of combined dots and uncombined dots. Further, the dot layout data includes a mixture of divided dots and undivided dots. Hence, there is increased reliability that the dot layout data will include a mixture of dots having different sizes.

(v) In the above-described embodiment, the recording density in the second pass and third pass of the dot layout data is lower than that in the first pass. Accordingly, the recording speed of the recording head 41 for the second and third passes is set faster than that for the first pass, thereby increasing the overall recording speed.

(vi) In the above-described embodiment, the amount of ink used for a combined dot is substantially equivalent to the sum of ink amounts corresponding to the plurality of dots prior to combination. Further, the surface area occupied by ink ejected onto the recording paper based on a combined dot is substantially equivalent to the sum of surface areas occupied by ink ejected based on the plurality of dots prior to combination. Further, the average density of ink ejected onto the recording paper based on a combined dot is substantially equivalent to the average density of ink ejected based on the plurality of dots prior to combination. Accordingly, recording based on combined dots instead of the plurality of dots prior to combining does not result in a loss of color reproducibility.

(vii) In the above-described embodiment, the total amount of ink corresponding to divided dots is substantially equivalent to the amount of ink corresponding to the original dot prior to division. Further, the total surface area occupied by ink ejected onto the recording paper based on divided dots is substantially equivalent to the surface area occupied by ink ejected based on the original dot prior to division. Further, the average density of ink ejected onto the recording paper based on divided dots is substantially equivalent to the average density of ink ejected based on the original dot prior to division. Accordingly, recording based on divided dots instead of the original dot prior to division does not result in a loss of is color reproducibility.

While the invention has been described in detail with reference to the specific embodiment thereof, it would be apparent to those skilled in the art that various changes and modifications may be made therein without departing from the spirit of the invention.

For example, in the above-described embodiment, both the combining process and dividing process are performed in the dot layout control process. However, only one of these processes may be performed.

In the above-described embodiment, the combining process of the dot layout control process is performed with a combining mask. However, the combining process may be performed with a method for randomly selecting pixels to be combined rather than using a combining mask. In this case, for example, if randomly selected three pixels are all "small" dots, the three "small" dots are converted into one "large" dot. That is, (S, S, S) is converted into (X, L, X), for instance. In another example, if randomly selected two pixels are all "medium" dots, the two "medium" dots are converted into one "large" dot. That is, (M, M) is converted into (L, X), for instance. In this modification, by combining dots for a plurality of pixels selected randomly from dots in a line of multilevel data, an appearance of specific patterns in the dot layout data can be prevented.

In the above-described embodiment, the dividing process of the dot layout control process is performed with a dividing mask for all the pixels in one line of the multilevel data. However, the dividing process may be implemented with a method for randomly selecting pixels to be divided and randomly selecting dividing patterns from the possible combinations in FIG. 14(*b*). In this modification, by randomly dividing dots in one line of multilevel data, an appearance of specific patterns in the dot layout data can be prevented.

What is claimed is:

1. An inkjet recording device for recording images by forming dots on a recording medium with droplet modulating method, comprising:

a recording unit that ejects ink droplets for forming dots at corresponding pixel positions, the recording unit capable of changing a volume of each ink droplet to form dots with different sizes;

a multilevel-data creating portion that creates multilevel data based on image data, the multilevel data including a dot size for each dot; and a dot-layout-data creating portion that creates dot layout data based on the multilevel data, so as to prevent the recording unit from forming dots having the same size continuously by greater than or equal to a predetermined value, the recording unit performing recording operation based on the dot layout data.

2. The inkjet recording device as claimed in claim 1, wherein the dot layout data includes multiple-pass data for controlling the recording unit to perform multiple-pass recording operation for a plurality of passes in a line in the multilevel data; and wherein the dot-layout-data creating portion includes a dividing portion dividing a dot at a predetermined pixel position in the multilevel data into a plurality of dots having smaller sizes, distributing the divided dots into the plurality of passes at the predetermined pixel position, and storing the divided and distributed dots in the multiple-pass data.

3. The inkjet recording device as claimed in claim 2, wherein the dividing portion creates the dot layout data using a dividing mask.

4. The inkjet recording device as claimed in claim 3, wherein the dividing mask is created by arranging combinations each including dot sizes for the plurality of passes.

5. The inkjet recording device as claimed in claim 4, wherein the predetermined value can be modified by changing how the combinations are selected and arranged.

6. The inkjet recording device as claimed in claim 2, wherein the dividing portion divides only a portion of dots in a line of the multilevel data.

7. The inkjet recording device as claimed in claim 2, wherein the dividing portion randomly divides dots in a line of the multilevel data and records the divided dots in the multiple-pass data.

8. The inkjet recording device as claimed in claim 7, wherein the dividing portion divides dots at pixel positions randomly selected from a line of the multilevel data.

9. The inkjet recording device as claimed in claim 2, wherein the recording unit performs the recording operation at a first recording speed when recording one pass of the plurality of passes during the multiple-pass operations; and wherein the recording unit performs the recording operation at a second recording speed different from the first recording speed when recording another pass of the plurality of passes.

10. The inkjet recording device as claimed in claim 9, wherein data for at least one pass of the multiple-pass data has a recording density different from a recording density of another pass.

11. The inkjet recording device as claimed in claim 2, wherein a total amount of ink corresponding to the divided dots is substantially equivalent to an amount of ink corresponding to the dot prior to division.

12. The inkjet recording device as claimed in claim 2, wherein a total surface area occupied by ink that is ejected onto a recording medium based on the divided dots is substantially equivalent to a surface area occupied by ink ejected based on the dot prior to division.

13. The inkjet recording device as claimed in claim 2, wherein an average density when ink is ejected onto a recording medium based on the divided dots is substantially equivalent to an average density when ink is ejected based on the dot prior to division.

14. The inkjet recording device as claimed in claim 1, wherein the dot-layout-data creating portion includes a combining portion combining dots at a plurality of pixel positions in a line of the multilevel data, the combining portion storing the combined dot at a position corresponding to one of the plurality of pixel positions in the dot layout data.

15. The inkjet recording device as claimed in claim 14, wherein the combining portion creates the dot layout data using a combining mask.

16. The inkjet recording device as claimed in claim 15, wherein the combining mask specifies a plurality of pixels.

17. The inkjet recording device as claimed in claim 16, wherein the predetermined value can be modified by changing a number of the plurality of pixels specified by the combining mask.

18. The inkjet recording device as claimed in claim 14, wherein the combining portion creates the combined dot by combining only a portion of dots in a line of the multilevel data.

19. The inkjet recording device as claimed in claim 14, wherein the combining portion creates the combined dot by combining dots at a plurality of pixel positions randomly selected from a line of the multilevel data.

20. The inkjet recording device as claimed in claim 14, wherein the combining portion combines a plurality of dots such that the combined dots are located in an area having a dot density in which the combined dots are not easily visible.

21. The inkjet recording device as claimed in claim 20, wherein the combining portion combines dots at a plurality of pixel positions that include a specific pixel position in the line of the multilevel data, only when a dot density in the neighborhood of the specific pixel position is greater than or equal to a predetermined value.

22. The inkjet recording device as claimed in claim 21, wherein the predetermined value is variable according to the size of the combined dot.

23. The inkjet recording device as claimed in claim 14, wherein an amount of ink corresponding to the combined dot is substantially equivalent to a total amount of ink corresponding to the plurality of dots prior to combination.

24. The inkjet recording device as claimed in claim 14, wherein a surface area occupied by ink ejected onto a recording medium based on the combined dot is substantially equivalent to a total surface area occupied by ink ejected based on the plurality of dots prior to combination.

25. The inkjet recording device as claimed in claim 14, wherein an average density when ink is ejected onto a recording medium based on the combined dot is substantially equivalent to an average density when ink is ejected based on the plurality of dots prior to combination.

26. The inkjet recording device according to claim 1, wherein the dot-layout-data creating portion prevents the recording unit from forming dots having the same size continuously by greater than or equal to the predetermined value in one scan of the recording unit.

27. An inkjet recording method for recording images by forming dots on a recording medium with droplet modulating method, using a recording unit capable of changing a volume of each ink droplet to form dots with different sizes, comprising:

creating multilevel data based on image data, the multilevel data including a dot size for each dot;

creating dot layout data based on the multilevel data, so as to prevent the recording unit from forming dots having the same size continuously by greater than or equal to a predetermined value; and performing recording operation by ejecting ink droplets, thereby forming dots at corresponding pixel positions based on the dot layout data.

28. The inkjet recording method as claimed in claim 27, wherein the dot layout data includes multiple-pass data for controlling the recording unit to perform multiple-pass recording operation for a plurality of passes per each line in the multilevel data; and wherein the step of creating dot layout data includes dividing a dot at a predetermined pixel position in the multilevel data into a plurality of dots having smaller sizes, distributing the divided dots into the plurality of passes at the predetermined pixel position, and storing the divided and distributed dots in the multiple-pass data.

29. The inkjet recording method as claimed in claim 27, wherein the step of creating dot layout data includes combining dots at a plurality of pixel positions in a line of the multilevel data for creating a combined dot, and storing the combined dot at a position corresponding to one of the plurality of pixel positions in the dot layout data.

30. The inkjet recording method according to claim 27, wherein the step for creating the dot layout includes preventing the recording unit from forming dots having the same size continuously by greater than or equal to the predetermined value in one scan of the recording unit.

* * * * *